US010584007B2

(12) United States Patent
Matsumura

(10) Patent No.: US 10,584,007 B2
(45) Date of Patent: Mar. 10, 2020

(54) SHEET FEEDING APPARATUS AND IMAGE FORMING APPARATUS

(71) Applicant: CANON KABUSHIKI KAISHA, Tokyo (JP)

(72) Inventor: Koichi Matsumura, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/878,649

(22) Filed: Jan. 24, 2018

(65) Prior Publication Data

US 2018/0215564 A1 Aug. 2, 2018

(30) Foreign Application Priority Data

Jan. 30, 2017 (JP) ..... 2017-014632

(51) Int. Cl.

| | |
|---|---|
| ***B65H 7/14*** | (2006.01) |
| ***B65H 1/04*** | (2006.01) |
| ***B65H 3/06*** | (2006.01) |
| ***B65H 5/06*** | (2006.01) |
| ***B65H 7/06*** | (2006.01) |

(52) U.S. Cl.

CPC ..... *B65H 7/14* (2013.01); *B65H 1/04* (2013.01); *B65H 3/0684* (2013.01); *B65H 5/062* (2013.01); *B65H 7/06* (2013.01); *B65H 2301/44324* (2013.01); *B65H 2511/152* (2013.01); *B65H 2511/17* (2013.01); *B65H 2513/512* (2013.01); *B65H 2553/414* (2013.01); *B65H 2553/822* (2013.01); *B65H 2801/03* (2013.01); *B65H 2801/06* (2013.01); *B65H 2801/39* (2013.01)

(58) Field of Classification Search

CPC ... B65H 3/06; B65H 7/06; B65H 7/14; B65H 7/18; B65H 2553/414; B65H 2553/416; B65H 2553/822; B65H 1/04; B65H 3/0684; B65H 5/062; B65H 2301/44324; B65H 2511/152; B65H 2511/17; B65H 2513/512

See application file for complete search history.

(56) References Cited

U.S. PATENT DOCUMENTS

2017/0355539 A1* 12/2017 Yoshiwara ..... B65H 3/06
2017/0359475 A1* 12/2017 Xie ..... G03G 15/55

FOREIGN PATENT DOCUMENTS

| | | | |
|---|---|---|---|
| JP | H08-119492 | A | 5/1996 |
| JP | 2004-277114 | A | 10/2004 |
| JP | 2008-007280 | A | 1/2008 |
| JP | 2016-135705 | A | 7/2016 |

* cited by examiner

*Primary Examiner* — David H Bollinger
(74) *Attorney, Agent, or Firm* — Venable LLP

(57) ABSTRACT

A sheet feeding apparatus includes a stacking surface on which a sheet is stacked, a feed portion configured to feed the sheet in a sheet feeding direction, and first and second detecting portions disposed at positions different from each other in a width direction orthogonal to the sheet feeding direction and so as to overlap with the stacking surface in a view from a height direction orthogonal to the stacking surface. The first and second detecting portions detect height positions which are positions in the height direction of an uppermost sheet. In addition, a control portion stops feeding the sheet by the feed portion based on at least one a height position detected by the first detecting portion and a height position detected by the second portion in feeding the sheet.

30 Claims, 25 Drawing Sheets

SHEET FEEDING APPARATUS AND IMAGE FORMING APPARATUS

BACKGROUND OF THE INVENTION

Field of the Invention

The present disclosure relates to a sheet feeding apparatus configured to feed a sheet and an image forming apparatus including the same.

Description of the Related Art

Generally, an image reading apparatus generally disposed above a printer body and configured to read an image of a document is known. The image reading apparatus includes an ADF (Auto Document Feeder) configured to feed a document placed on a document platen while separating one by one. The ADF is unable to feed a so-called bound document or the like stapled or glued, and if the ADF tries to feed the bound document, there is a case where the document is wrinkled or torn in a mechanism within the ADF that separates the documents. Still further, if the bound document is fed as it is without being separated within the ADF, there is a possibility that the document is jammed on a conveyance path.

Hitherto, Japanese Patent Application Laid-open No. 2008-7280 proposes an image reading apparatus provided with a plurality of detection sensors disposed on both sides of a document platen in a width direction and configured to judge whether a bound document is present by a light beam outputted approximately in a horizontal direction from a light emitting component of each of the detection sensors in a case where the light is blocked by the bound document. The plurality of detection sensors is disposed respectively at different height positions and detects multilevel lift amounts of the bound document.

That is, a pickup roller provided in the ADF feeds only an uppermost sheet of the bound document in feeding the bound document by the ADF. However, because the uppermost sheet is bound by a staple or the like, the uppermost sheet is lifted up by being fed by the pickup roller. The ADF stops feeding the bound document as soon as the plurality of detection sensors detects that the lift amount of the uppermost sheet exceeds a predetermined height.

Still further, in a case where the detection sensors detect a lift of a document on the document platen before feeding the document, it is possible to set that the amount of the lift as an offset level and to judge that a bound document is being fed by the lift of the document from that offset level.

In the image reading apparatus described in Japanese Patent Application Laid-open No. 2008-7280, however, the detection sensors are disposed on the widthwise both sides of the document platen and the light beams of the detection sensors are outputted approximately in the horizontal directions. Therefore, in a case where a widthwise end portion of a document is curled upward, there is a possibility that the image reading apparatus erroneously detects that the curled document as a bound document.

Still further, in a case where a widthwise end portion of a bound document is curled and a lift occurs inside in a width direction of the curl by feeding the document, there is a case where the image reading apparatus is unable to detect a lift amount lower than a height of the curl and to detect the bound document.

Still further, because the image reading apparatus judges the bound document by adding an offset level to the lift occurring inside of the curl, the image reading apparatus may not be able to detect the bound document or may become late to detect the bound document if the height of the curled end portion is set as an offset level.

SUMMARY OF THE INVENTION

According to a first aspect of the present invention, a sheet feeding apparatus includes a stacking surface on which a sheet is stacked, a feed portion configured to feed the sheet stacked on the stacking surface in a sheet feeding direction, first and second detecting portions disposed at positions different from each other in a width direction orthogonal to the sheet feeding direction and so as to overlap with the stacking surface in a view from a height direction orthogonal to the stacking surface, the first and second detecting portions being configured to detect height positions which are positions in the height direction of an uppermost sheet stacked on the stacking surface at the respective positions in the width direction, and a control portion configured to start feeding the sheet stacked on the stacking surface by the feed portion and to stop feeding the sheet by the feed portion, wherein the control portion is configured to stop feeding the sheet based on at least one detection result of the first and second detecting portions in feeding the sheet.

According to a second aspect of the present invention, a sheet feeding apparatus includes a stacking surface on which a sheet is stacked, a feed portion configured to feed the sheet stacked on the stacking surface in a sheet feeding direction, a first detecting portion including a first light emitting portion configured to irradiate an uppermost sheet stacked on the stacking surface with light and a first photo-sensing portion configured to receive the light irradiated from the first light emitting portion and reflected by the uppermost sheet, disposed so as to overlap with the stacking surface in a view of a height direction orthogonal to the stacking surface, and configured to detect a height position which is a position of the uppermost sheet in the height direction based on a time from when the first light emitting portion irradiates the light and until when the light irradiated from the first light emitting portion is received by the first photo-sensing portion, a second detecting portion including a second light emitting portion configured to irradiate the uppermost sheet stacked on the stacking surface with light and a second photo-sensing portion configured to receive the light irradiated from the second light emitting portion and reflected by the uppermost sheet, disposed at a position different from that of the first detecting portion in a width direction orthogonal to the sheet feeding direction and so as to overlap with the stacking surface in a view of the height direction, and configured to detect a height position of the uppermost sheet at a position different from a detecting position of the first detecting portion in the width direction based on a time from when the second light emitting portion irradiates the light and until when the light irradiated from the second light emitting portion is received by the second photo-sensing portion, a control portion configured to start feeding the sheet stacked on the stacking surface by the feed portion and to stop feeding the sheet by the feed portion, wherein the control portion is configured to stop feeding the sheet based on at least one detection result of the first and second detecting portions in feeding the sheet.

Further features of the present invention will become apparent from the following description of exemplary embodiments with reference to the attached drawings.

DESCRIPTION OF THE EMBODIMENTS

First Embodiment

Overall Configuration

Figure 1A:
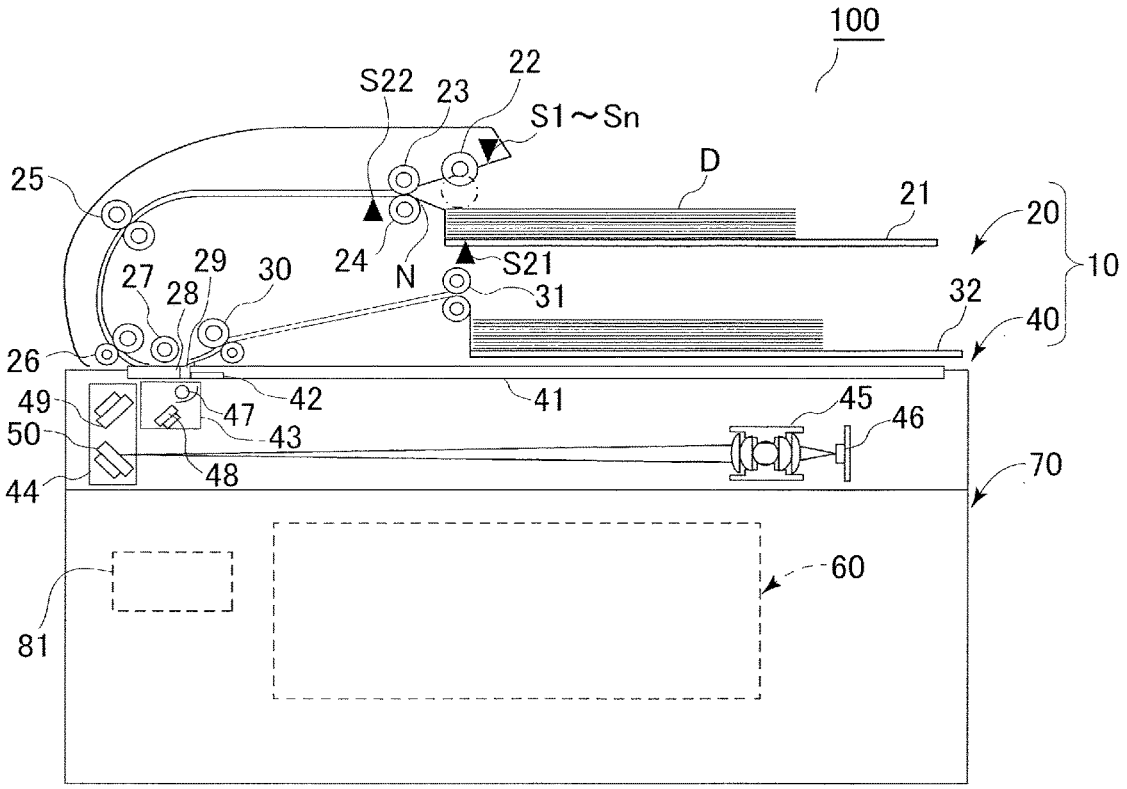
FIG. 1A is a schematic diagram illustrating an overall configuration of a printer of a first embodiment of the present disclosure.

A first embodiment of the present disclosure will be described first. A printer 100 serving as an image forming apparatus of the first embodiment is an electro-photographic laser beam printer. As illustrated in FIG. 1A, the printer 100 includes a printer body 70 and an image reading apparatus 10 installed above the printer body 70. It is noted that a 'sheet' includes, besides a plain sheet, a special sheet such as a coated sheet, a recording material having a special shape such as an envelope and an index sheet, a plastic film for an overhead projector, and cloth, and the 'document' is also one exemplary sheet.

Figure 1B:
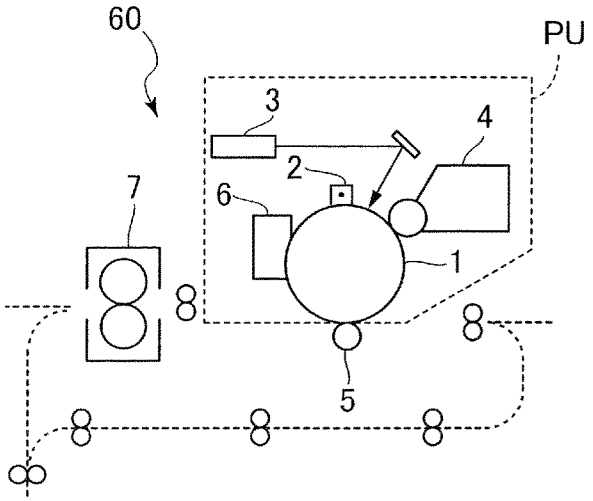
FIG. 1B is a schematic diagram illustrating an image forming engine.

The printer body 70 includes an image forming engine 60. As illustrated in FIG. 1B, the image forming engine 60 includes an image forming unit PU serving as a photo-electronic image forming unit and a fixing unit 7. As soon as an image forming operation is started, a photosensitive drum 1 serving as a photo-conductor rotates such that a drum surface is uniformly electrified by an electrifying unit 2. Then, an exposure unit 3 modulates and outputs a laser beam based on image data transmitted from an image reading apparatus 10 serving as an image reading portion or an external computer to scan the surface of the photosensitive drum 1 to form an electrostatic latent image. This electrostatic latent image is visualized (developed) by toner supplied from a developing unit 4 to be a toner image.

In parallel with such image forming operation, a feed operation of feeding a sheet stacked in a cassette or in a manual feed tray not illustrated toward the image forming engine 60 is executed. The sheet thus fed is conveyed in synchronism with an advance of the image forming operation in the image forming unit PU. Then, the toner image borne on the photosensitive drum 1 is transferred onto a sheet by a transfer roller 5. The toner left on the photosensitive drum 1 after the transfer of the toner is collected by a cleaning unit 6. The sheet onto which the non-fixed toner image has been transferred is passed to the fixing unit 7 to be heated and pressurized while being nipped by a roller pair. The sheet onto which the toner has melted and fixed is discharged out of the apparatus by a discharge portion such as a discharge roller pair.

Image Reading Apparatus

Next, the image reading apparatus 10 will be described in detail. As illustrated in FIG. 1A, the image reading apparatus 10 includes an ADF (Auto Document Feeder) 20 configured to feed a document stacked on a stacking tray 21 and to discharge the document to a discharge tray 32 and a reading unit 40 configured to read the document conveyed by the ADF 20. The ADF 20 is supported by a hinge turnably with respect to the reading unit 40 such that a document base glass 41 is exposed. It is noted that the document D which is one exemplary sheet may be a blank sheet of paper or may be a sheet on which an image (images) is formed on one surface or both surfaces.

The ADF 20 includes a pickup roller 22 serving as a feed portion, a separation driving roller 23 and a separation driven roller 24, a registration roller pair 25, conveyance roller pairs 26 and 30 and a discharge roller pair 31. The ADF 20 also includes a document presence detecting sensor S21 configured to detect the document D present on the stacking tray 21, a post-separation sensor S22 configured to detect the document D disposed downstream of the separation driving roller 23 in a sheet feeding direction, and a plurality of height detecting sensors S1 through Sn.

The reading unit 40 includes a platen glass 28, a jump base 29, a reference white board 42, a document platen glass 41, a first mirror base 43, a second mirror base 44, a lens 45, and a CCD line sensor 46. A lamp 47 and a mirror 48 are disposed within the first mirror base 43, and mirrors 49 and 50 are disposed within the second mirror base 44. The first and second mirror bases 43 and 44 are configured to be movable by a wire and a driving motor not illustrated in a sub-scan direction which is a right-and-left direction in FIG. 1A.

The image reading apparatus 10 reads image information from the document D stacked on the stacking tray 21 in a feeding-reading mode in which the image reading apparatus 10 scans the document image while feeding the document D by the ADF 20 and in a fixed reading mode in which the image reading apparatus 10 scans the document placed on the document base glass 41. The feeding-reading mode is selected in a case where the document presence detecting sensor S21 detects the document D stacked on the stacking tray 21 or where a user clearly selects the mode through a control panel or the like of the printer body 70.

In the case where the feeding-reading mode is executed, the pickup roller 22 supported by an arm not illustrated drops and abuts with the uppermost document D placed on the stacking tray 21. Then, the document D is fed by the pickup roller 22 and is separated one by one at a separation nip N serving as a separating portion formed by the separation driving roller 23 and the separation driven roller 24. The separation driving roller 23 is formed of rubber or the like whose friction is slightly less than that of the separation driven roller 24. A torque limiter is disposed in a drive transmission path to the separation driven roller 24. The separation driven roller 24 rotates with the separation driving roller 23 when one document is fed and does not rotate when two documents are fed. It is thus possible to separate the document one by one. It is noted that a drive in a direction opposite to the sheet feeding direction may be inputted to the separation driven roller 24.

Leading and trailing edges of the document which has passed through the separation nip N are detected by the post-separation sensor S22 and become bases for an elevation timing and driving start and stop timings of the pickup roller 22 and for driving start and stop timings of the registration roller pair 25. It is noted that the pickup roller 22 and the separation driving roller 23 are connected with one and the same driving source.

The leading edge of the conveyed document D butts against the registration roller pair 25 being in a halt condition, so that a skew of the document D is corrected. The document D whose skew has been corrected is conveyed further by the registration roller pair 25 and conveyed by the conveyance roller pair 26 toward the platen glass 28. A platen guide roller 27 is disposed so as to face the platen glass 28 to guide the document D passing through the platen glass 28 such that the document D is not lifted from the platen glass 28.

Then, the image on the surface of the document D is read by the reading unit 40 through the platen glass 28. More specifically, light of the lamp 47 is illuminated to the document D being conveyed, and reflection light from the document D is guided to the lens 45 through the mirrors 48, 49 and 50. Then, the light that has passed through the lens 45 is imaged on a photo-sensing portion of the CCD line sensor 46 to be photo-electrically converted to be transmitted as image information to a CPU 81. It is noted that the reference white board 42 becomes a base of reading brightness of the document D. The document D that has passed through the platen glass 28 is guided by the jump base 29 to the conveyance roller pair 30 and is discharged by the discharge roller pair 31 to the discharge tray 32.

Meanwhile, the fixed-reading mode is selected in a case where the image reading apparatus 10 detects the document D stacked on the document base glass 41 or where the user clearly selects this mode through the control panel or the like of the printer body 70. In this case, the document D on the document base glass 41 does not move, and the first and second mirror bases 43 and 44 move along the document base glass 41. Then, the document D is scanned by the light illuminated by the lamp 47. Image information photo-electronically converted by photosensitive elements of the CCD line sensor 46 is transferred to the CPU 81.

Height Detecting Sensor

Figure 2A:
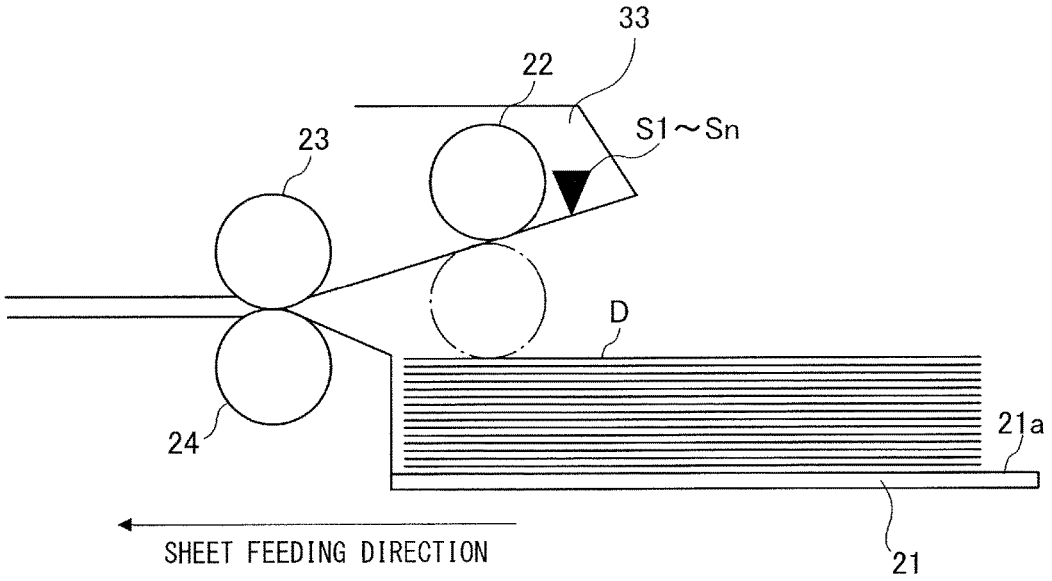
FIG. 2A illustrates a plurality of height detecting sensors seen from a sheet width direction orthogonal to a sheet feeding direction.
Figure 2B:
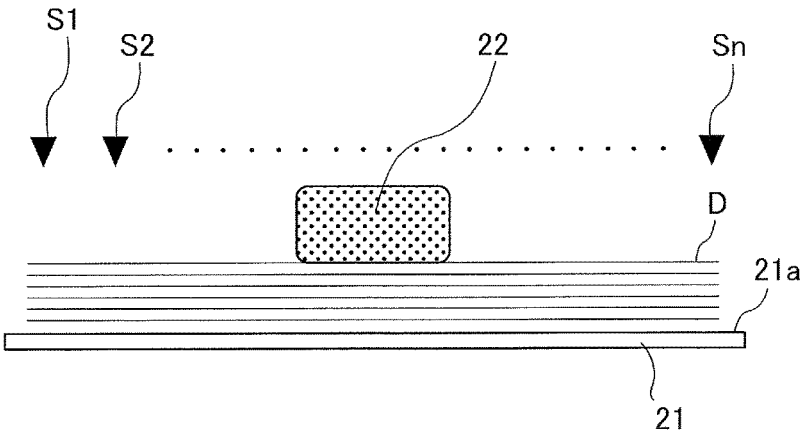
FIG. 2B illustrates the plurality of height detecting sensors seen from the sheet feeding direction.

As illustrated in FIGS. 2A and 2B, the height detecting sensors S1 through Sn are provided in a frame 33 of the ADF 20 and are disposed above the stacking tray 21 at positions different from each other in a width direction orthogonal to the sheet feeding direction. More specifically, the height detecting sensors S1 through Sn are disposed so as to overlap with a stacking surface 21*a* of the stacking tray 21 seen from a height direction orthogonal to the stacking surface 21*a*. It is noted that although the height detecting sensors S1 through Sn are disposed in the present embodiment, any number of height detecting sensors may be provided as long as the number is two or more. That is, arbitrary two sensors of the height detecting sensors S1 through Sn are first and second detecting portions. Still further, at least one each height detecting sensor is disposed on a first side with respect to the pickup roller 22 and a second side, opposite to the first side, with respect to the pickup roller 22 in the width direction.

Figure 3A:
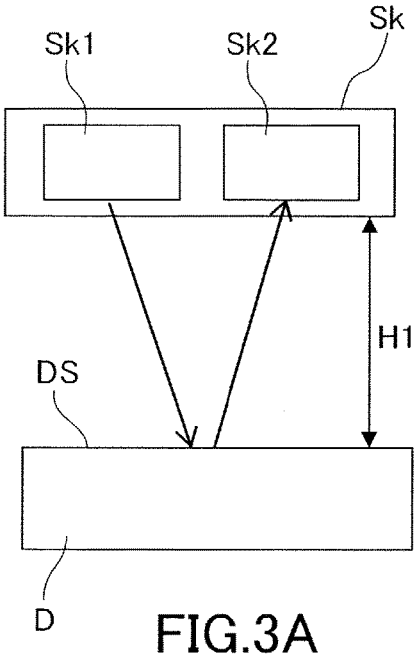
FIG. 3A is a diagrammatic view illustrating a height detecting sensor located at a position close to a document surface.
Figure 3B:
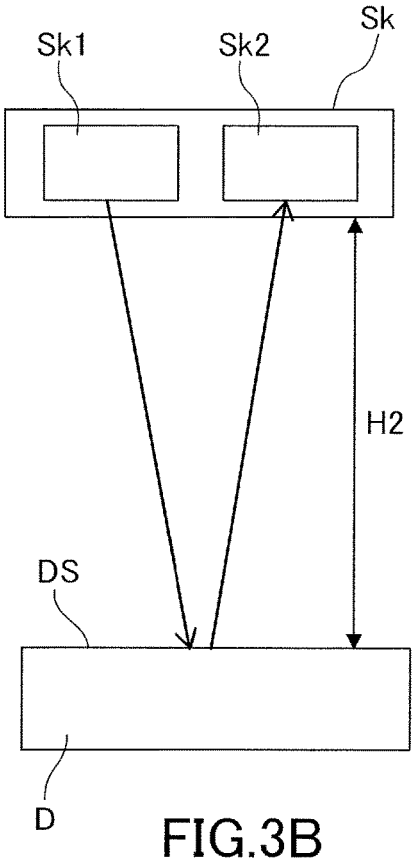
FIG. 3B is a diagrammatic view illustrating a height detecting sensor located at a position distant from the document surface.

Because the height detecting sensors S1 through Sn are configured in the same manner, an arbitrary height detecting sensor among the height detecting sensors S1 through Sn will be described by denoting as a height detecting sensor Sk hereinafter. As illustrated in FIGS. 3A and 3B, the height detecting sensor Sk includes a light emitting portion Sk1 serving as a first light emitting portion or a second light emitting portion illuminating the uppermost document D stacked on the stacking tray 21 with light and a photo-sensing portion Sk2 serving as a first photo-sensing portion or a second photo-sensing portion receiving the reflected light from the document D.

Figure 3C:
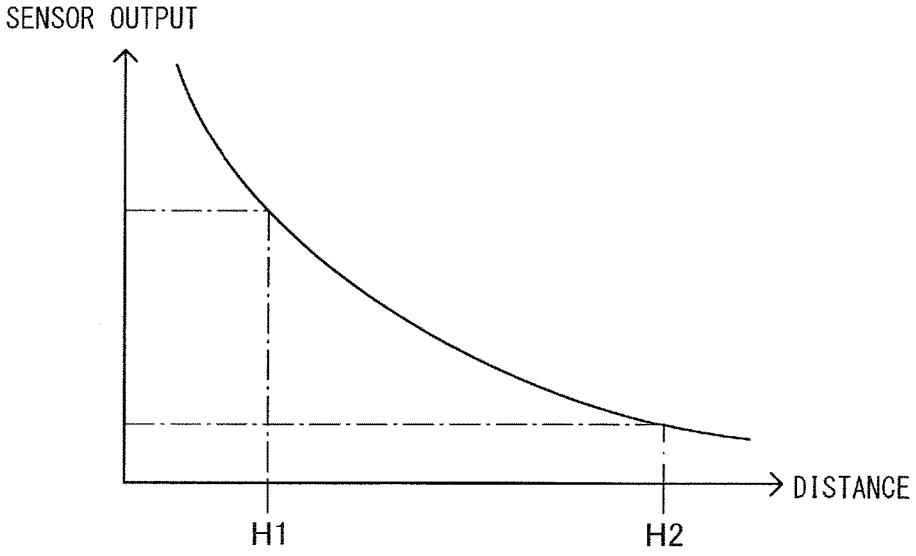
FIG. 3C is a graph indicating a relationship between a distance between the document surface and the height detecting sensor and a sensor output.

As illustrated in FIG. 3A, a quantity of light received by the photo-sensing portion Sk2 is large because the photo-sensing portion Sk2 receives more light flux reflected by a document surface DS in a case where a distance H1 between the document surface DS of the document D and the height detecting sensor Sk is relatively small. As illustrated in FIG. 3B, a quantity of light received by the photo-sensing portion Sk2 is small because the photo-sensing portion Sk2 receives less light flux reflected by the document surface DS in a case where a distance H2 between the document surface DS of the document D and the height detecting sensor Sk is relatively large (H2>H1). Then, an output of the height detecting sensor Sk is determined in accordance to the quantity of light received by the photo-sensing portion Sk2. That is, the height detecting sensor Sk transmits a signal based on a degree of the quantity of light received by the photo-sensing portion Sk2 to the CPU 81. FIG. 3C is a graph indicating a relationship between the distance between the document surface DS and the height detecting sensor Sk and the sensor output. The CPU 81 detects a height position, which is a position in the height direction, of the document at each detection position in response to signals corresponding to sensor outputs transmitted from the respective height detecting sensors S1 through Sn. Although the present embodiment is configured such that the height detecting sensors S1 through Sn detect the upstream height position in the sheet feeding direction of the document, it is also possible to configure such that the sensors detect a downstream height position of the document.

Here, a principle why a document is lifted in a case where a stapled or glued document, i.e., a so-called 'bound document', is fed will be described. It is noted that the 'bound document' in the present embodiment is not limited to the stapled or glued document and may be a stapleless bound document or a book-bound document.

Figure 4:
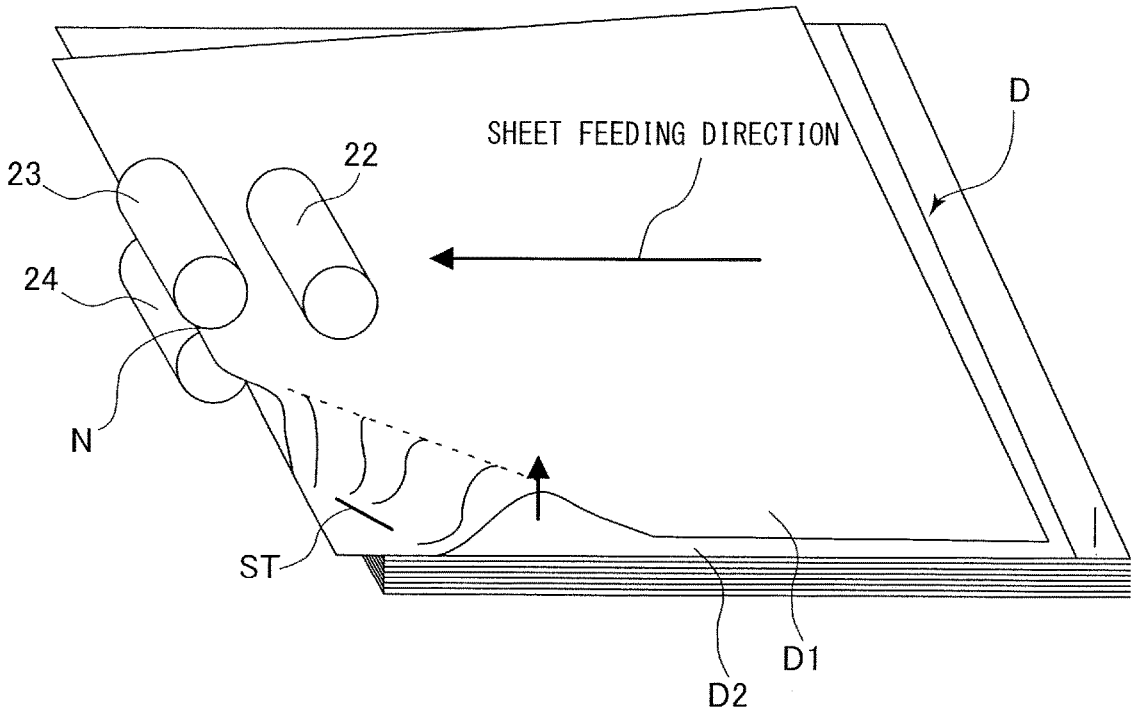
FIG. 4 is a perspective view illustrating how an uppermost sheet of a bound document is lifted up.

A case of feeding a bound document D, i.e., a sheet bundle, in which leading edge corners of first and second sheets D1 and D2 are connected by a staple ST as illustrated in FIG. 4 will be examined. If the document D is fed by the pickup roller 22, the document D butts against and stops at the separation nip N.

The pickup roller 22 abuts with an upper surface of the first sheet D1 of the document D and applies a feeding force to the first sheet D1 even in a condition in which the leading edge of the document D is stopped at the separation nip N. However, because the first sheet D1 is connected with the second sheet D2, being stopped, by the staple ST, the first sheet D1 starts to be lifted up from a vicinity of the staple ST as the pickup roller 22 feeds the first sheet D1. In a case where the bound document is thus fed by the pickup roller 22, the first sheet D1 causes such characteristic lift or deflection.

Control Block

Figure 5:
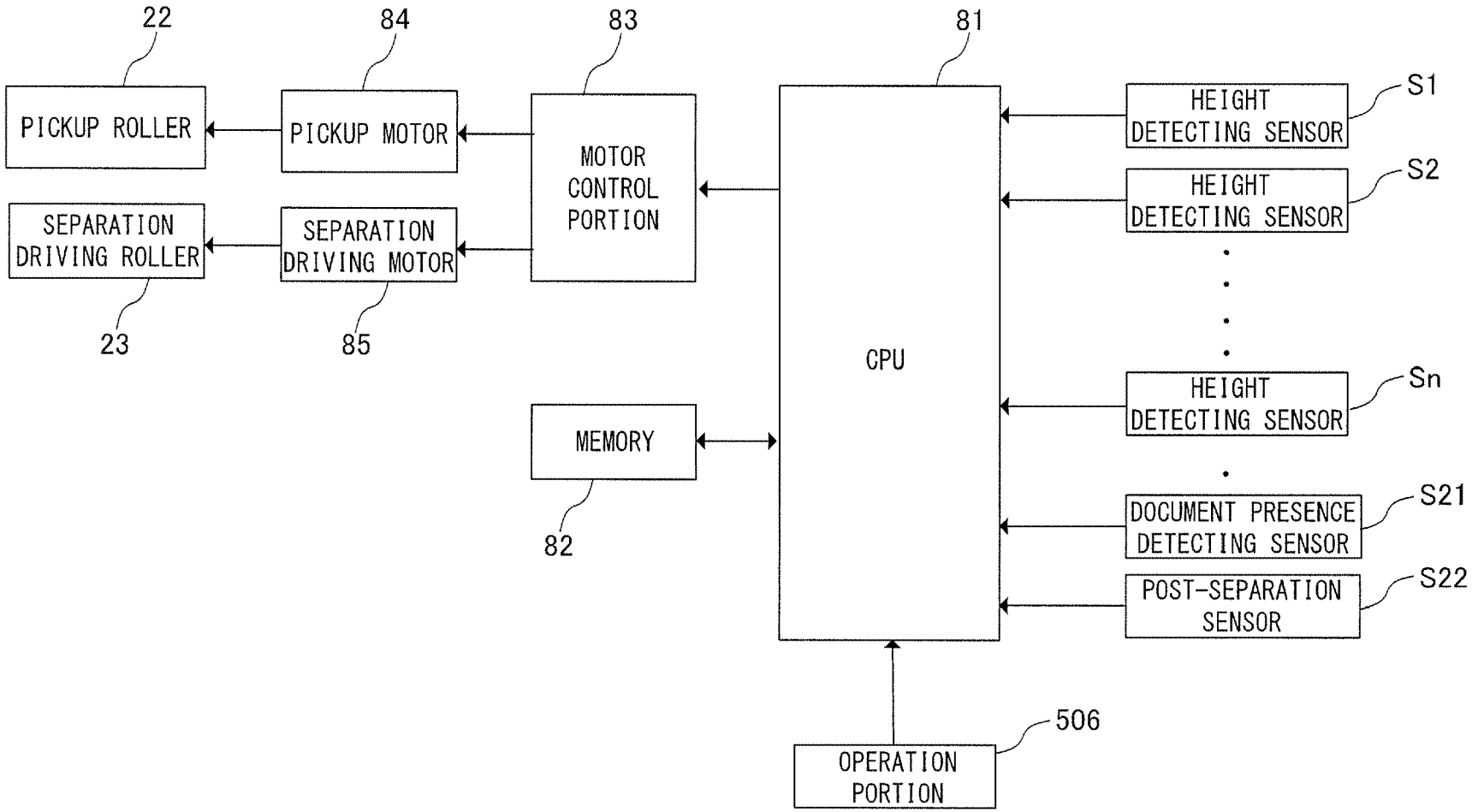
FIG. 5 is a control block diagram of the first embodiment.

FIG. 5 is a control block diagram of the CPU 81 serving as a control portion. As illustrated in FIG. 5, the height detecting sensors S1 through Sn, the document presence detecting sensor S21 and the post-separation sensor S22 are connected to an input side of the CPU 81. A pickup motor 84 and a separation driving motor 85 are connected to an output side of the CPU 81 through a motor control portion 83. The pickup motor 84 drives the pickup roller 22, and the separation driving motor 85 drives the separation driving roller 23.

An operation portion 506 and a memory 82 are also connected to the CPU 81. The operation portion 506 includes an operation panel for example so as to permit to start a copying job and to make various settings. A variation $\alpha$ of a lift of a document D for judging that the document is a bound document is stored in the memory 82.

Detection of Bound Document

Figure 6:
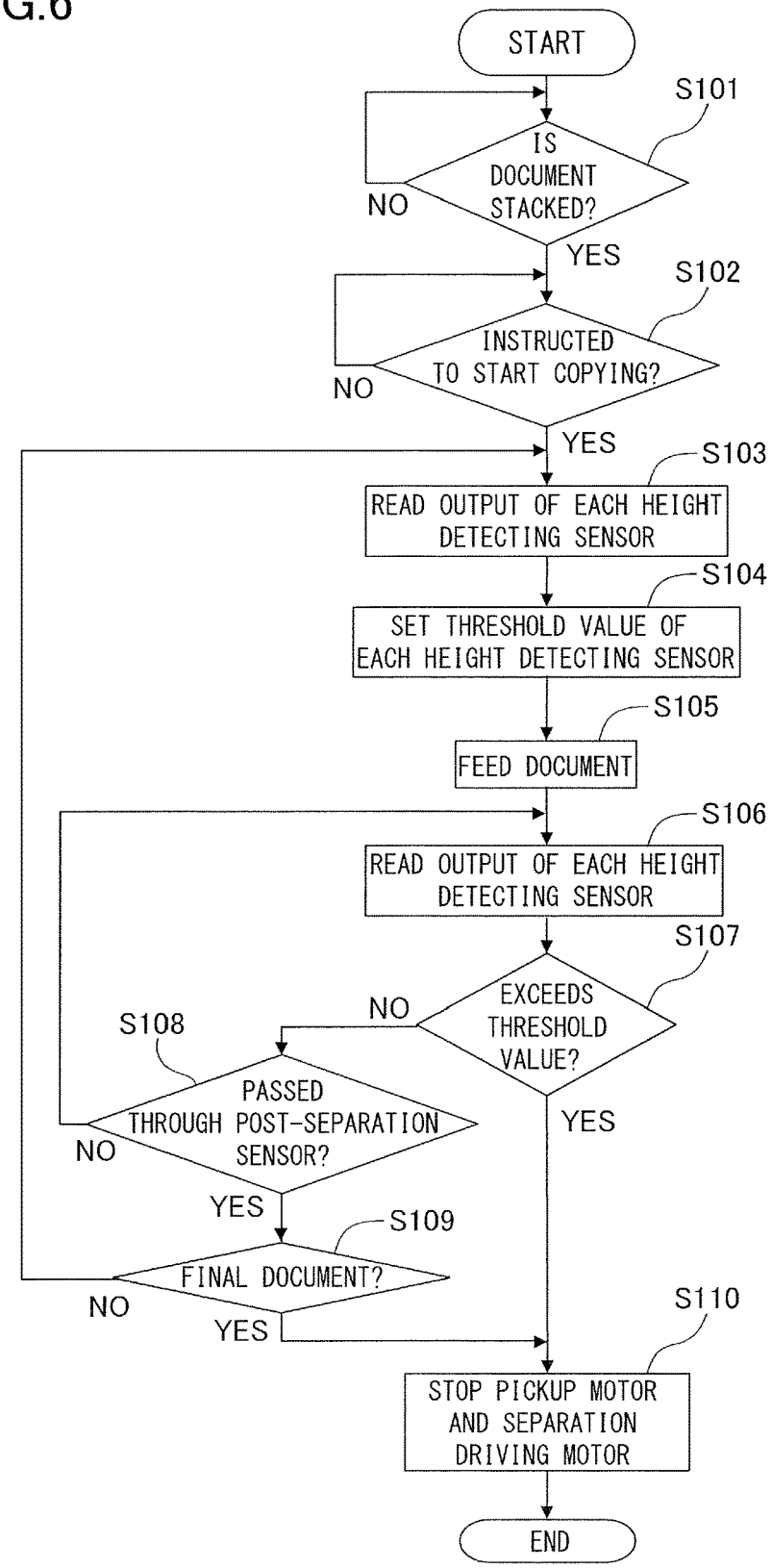
FIG. 6 is a flowchart illustrating a copying operation in feeding the bound document.

Next, a copying operation in a case where a bound document is fed will be described along with a flowchart illustrated in FIG. 6. As illustrated in FIG. 6, at first the CPU 81 determines whether a document is stacked on the stacking tray 21 by the document presence detecting sensor S21 in Step S101. In a case where no document is staked on the stacking tray 21, i.e., No in Step S101, the CPU 81 does not advance to a next step and stands by until when a document is stacked on the stacking tray 21.

In a case where the CPU 81 judges that the document is stacked on the stacking tray 21, i.e., Yes in Step S101, the CPU 81 determines whether a copying job is instructed to be started in Step S102. In a case where there is no instruction to start a copying job through the operation portion 506, i.e., No in Step S102, the CPU 81 does not advance to a next step and stands by until a copying job is instructed to be started.

In a case where the CPU 81 judges that the copying job is instructed to be started, i.e., Yes in Step S102, the CPU 81 reads outputs of the respective height detecting sensors S1 through Sn before feeding the document D in Step S103. That is, the light emitting component of each detection sensor irradiates light to the uppermost document D as described above to determine the output of the height detecting sensor corresponding to a degree of a quantity of light of reflected light received by the photo-sensing portion. Thereby, it is possible to detect a height position of the uppermost document D at a detection position of each height detecting sensor.

Here, an output before feeding the document of an arbitrary height detecting sensor Sk will be set as an output OP1 (Sk), an output in feeding the document will be set as an output OP2 (Sk), and a threshold value of the height detecting sensor Sk will be set as a threshold value TH (Sk), respectively for convenience. The CPU 81 adds the predetermined variation $\alpha$ stored in the memory 82 to the outputs OP1 (S1) through OP1 (Sn) of the respective height detecting sensors S1 through Sn before feeding the document to set threshold values TH (S1) through TH (Sn) for the respective height detecting sensors S1 through Sn. Then, the CPU 81 stores the threshold values TH (S1) through TH (Sn) in the memory 82.

Next, the CPU 81 feeds the document D by the pickup roller 22 in Step S105 and reads the outputs OP2 (S1) through OP2 (Sn) in feeding the document of the respective height detecting sensors in Step S106. Then, the CPU 81 judges whether anyone of the outputs OP2 (S1) through OP2

(Sn) exceeds the threshold values TH (S1) through TH (Sn) of the corresponding height detecting sensors in Step S107.

At this time, as illustrated in FIGS. 7A through 8A, no lift characteristic to a document of a bound document occurs in feeding a regular document, i.e., a non-bound document. Due to that, as illustrated in FIG. 9A, an output of the output OP2 (Sk) of the height detecting sensor Sk in feeding the document is kept low. Accordingly, none of the outputs OP2 (S1) through OP2 (Sn) exceeds the respectively corresponding threshold values TH (S1) through TH (Sn) in feeding the regular document, i.e., No in Step S107, and the process advances to Step S108. In Step S108, the CPU 81 judges whether a leading edge of the fed document D has passed through the post-separation sensor S22, and repeats Steps S106 through S108 if the leading edge of the document D has not passed through the post-separation sensor S22.

In a case where the leading edge of the fed document D has passed through the post-separation sensor S22, i.e., Yes in Step S108, the CPU 81 judges whether the fed document D is a final document of the copying job in Step S109. The CPU 81 judges that the fed document is the final document in a case where the CPU 81 detects that no document is stacked on the stacking tray 21 by the document presence detecting sensor S21. In a case where the fed document D is not a final document, the CPU 81 returns to Step S103, or advances the process to Step S110 in a case where the document D is the final document. Then, the CPU stops the pickup motor 84 and the separation driving motor 85 in Step S110 to stop feeding.

Figure 7A:
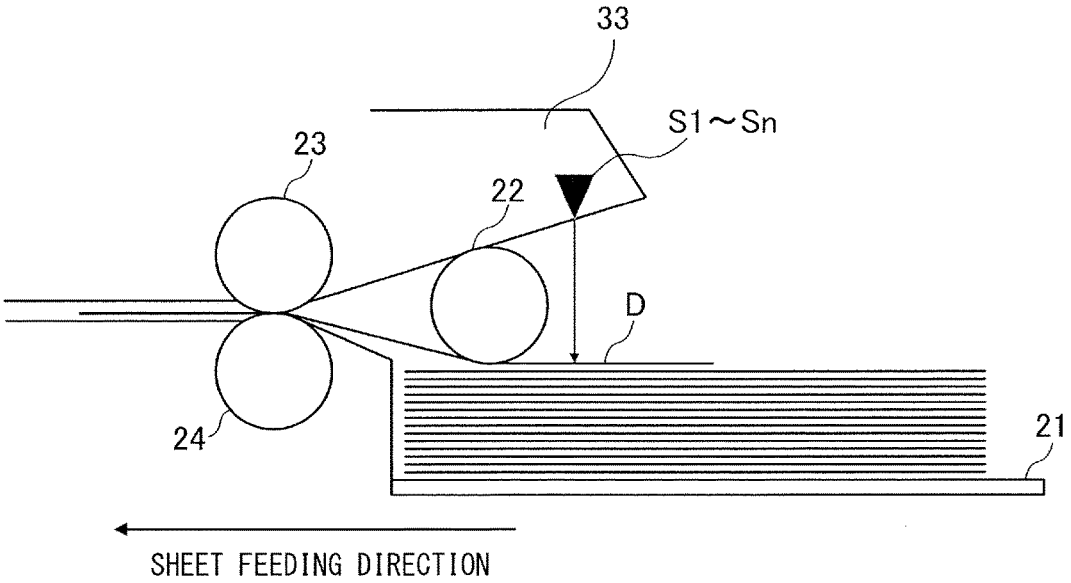
FIG. 7A is a side view illustrating a regular document being fed and seen from the width direction.
Figure 7B:
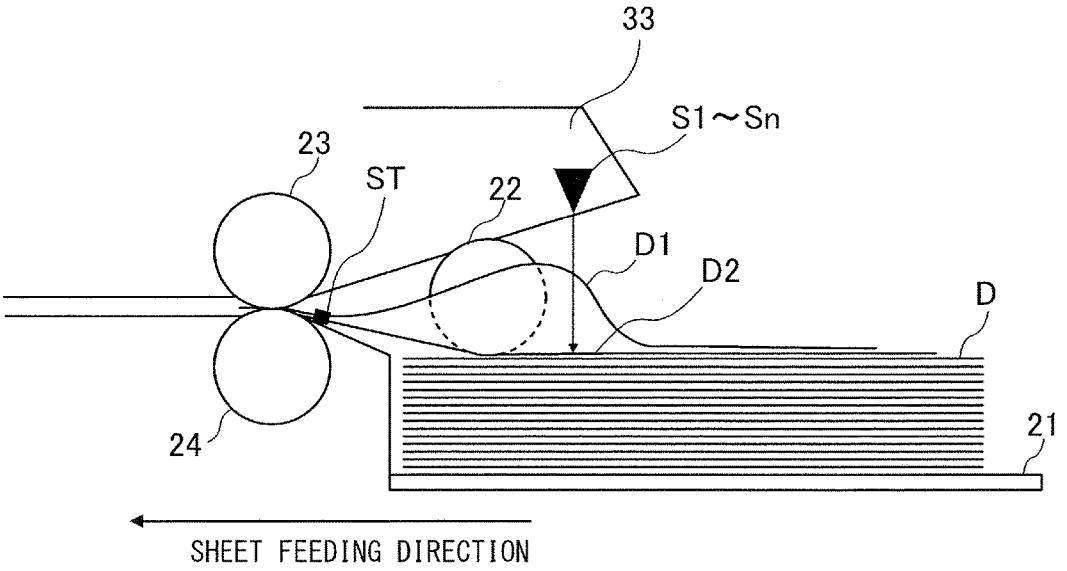
FIG. 7B is a side view illustrating the bound document being fed and seen from the width direction.
Figure 8A:
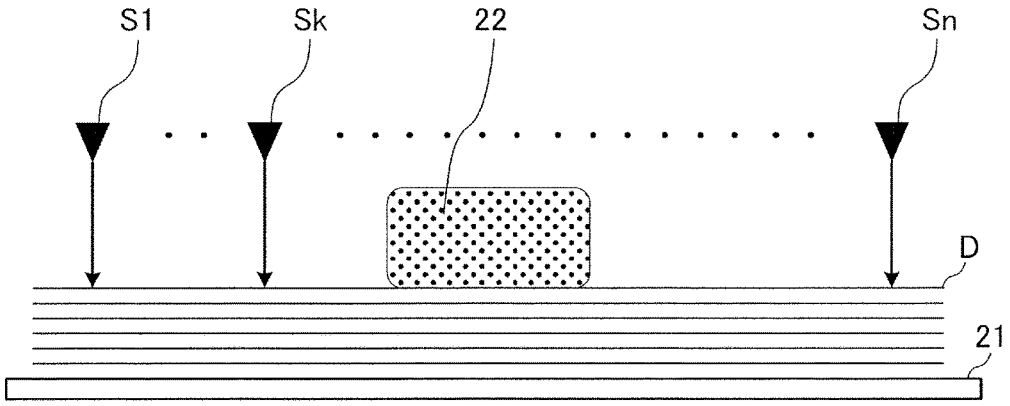
FIG. 8A is side view illustrating the regular document being fed seen from the sheet feeding direction.
Figure 8B:
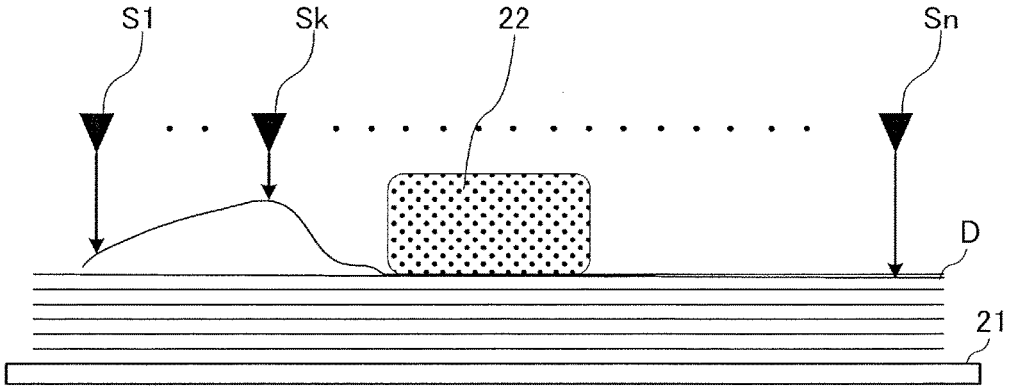
FIG. 8B is a side view illustrating the bound document being fed and seen from the sheet feeding direction.
Figure 9A:
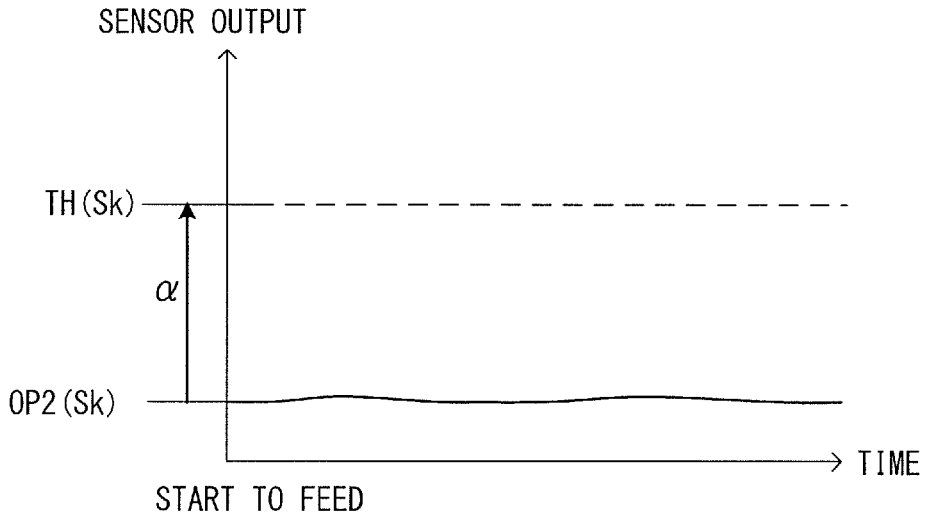
FIG. 9A is a graph indicating an output of the height detecting sensor during when the regular document is fed.
Figure 9B:
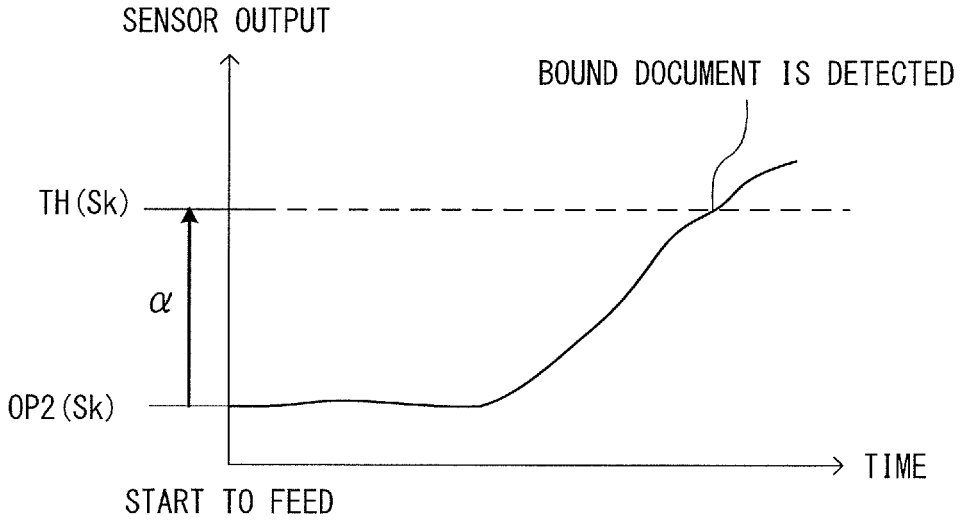
FIG. 9B is a graph indicating an output of the height detecting sensor during when the bound document is fed.

Next, in a case where the bound document is fed as illustrated in FIGS. 7B and 8B, the first sheet D1, i.e., the uppermost document D, is lifted up as the document D is fed, and a height position of the first sheet D1 partially rises. Due to that, the output OP2 (Sk) of the height detecting sensor Sk rises as the bound document is fed as illustrated in FIG. 9B. Then, the CPU 81 judges whether anyone of outputs OP2 (S1) through OP2 (Sn) in feeding the document of the respective height detecting sensors exceeds the threshold values TH (S1) through TH (Sn) of the respectively corresponding height detecting sensors. In a case where the output of either one of the height detecting sensors exceeds the threshold value, i.e., Yes in Step S107, the CPU 81 judges that a bound document is being fed. For instance, in a case where a threshold value TH (Sk) is set as a first threshold value for the height detecting sensor Sk serving as a first detecting portion and a threshold value TH (Sk+1) is set as a second threshold value for the height detecting sensor Sk+1 serving as a second detecting portion, the CPU 81 judges that the document is a bound document in a case where either one of the height detecting sensors Sk and Sk+1 detects a height position exceeding the respective threshold values TH (Sk) and TH (Sk+1).

That is, the CPU 81 judges that the bound document is being fed in a case where a variation of the height position detected by either one of the height detecting sensors exceeds the variation $\alpha$ before and in feeding the document. In other words, the CPU 81 judges that the document is the bound document in a case where a difference of height positions of the sheet detected by either one of the first and second detecting portions before feeding the document and in feeding the document is larger than the variation $\alpha$ set as a predetermined first value. Then, the CPU 81 stops the pickup motor 84 and the separation driving motor 85 to stop feeding the document in Step S110.

Figure 10A:
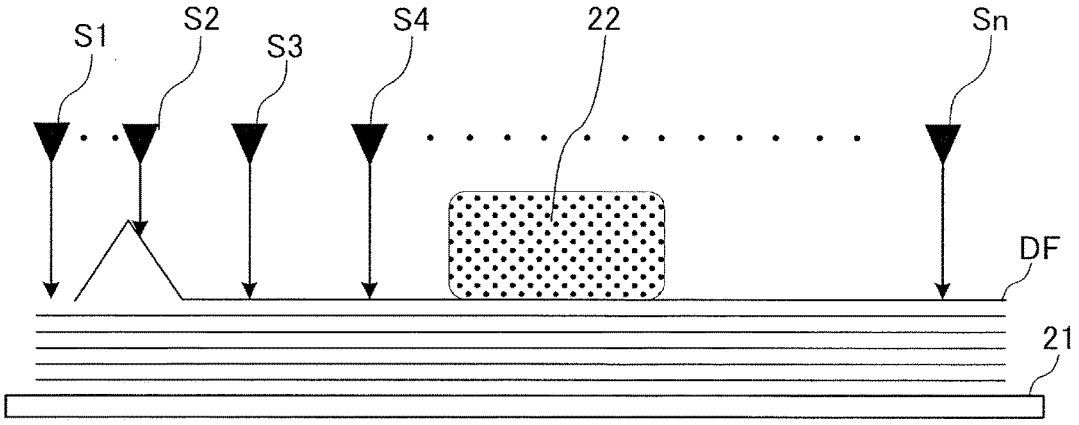
FIG. 10A is a side view illustrating a document whose end portion is folded and seen from the sheet feeding direction.
Figure 11A:
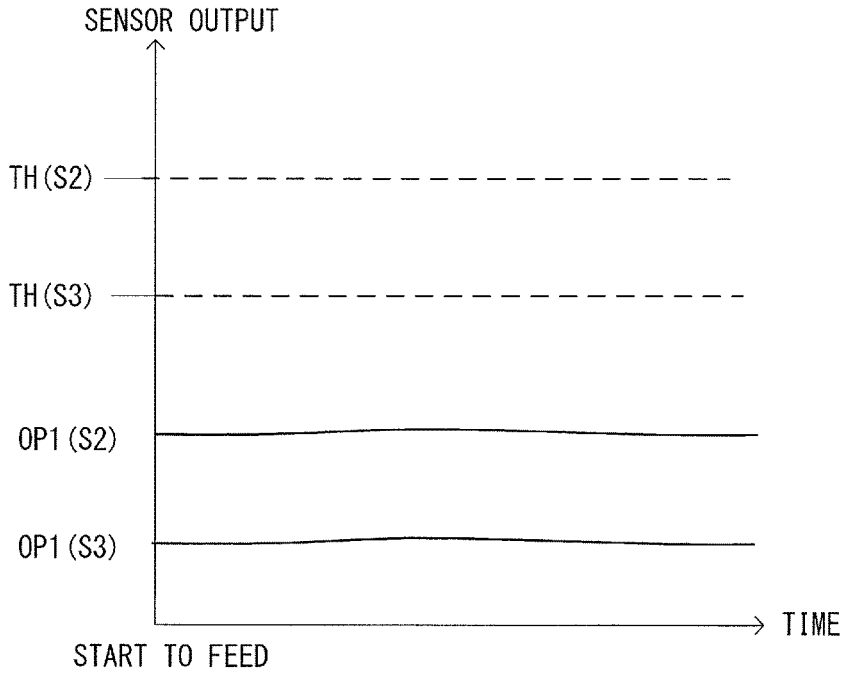
FIG. 11A is a graph indicating an output of the height detecting sensor before when the folded document is fed.

It is possible to deal with a case where a first document of the bound document is a folded document whose end portion is folded or a curled document whose end portion is curled for example in the present embodiment. For instance, a case where a folded document DF in which a widthwise end portion of the document is folded as illustrated in FIG. 10A is fed will be examined. The fold of the folded document DF is formed at the detection position of the height detecting sensor S2. Therefore, outputs OP1 (S2) and OP1 (S3) of the height detecting sensors S2 and S3 before feeding the document are indicated as illustrated in FIG. 11A. The output OP1 (S2) of the height detecting sensor S2 is higher than the output OP1 (S3) of the height detecting sensor S3. The threshold values TH (S2) and TH (S3) are set respectively based on the outputs OP1 (S2) and OP1 (S3) of the height detecting sensors S2 and S3. A difference between the threshold values TH (S2) and TH (S3) corresponds to a difference between the outputs OP1 (S2) and OP1 (S3).

Figure 10B:
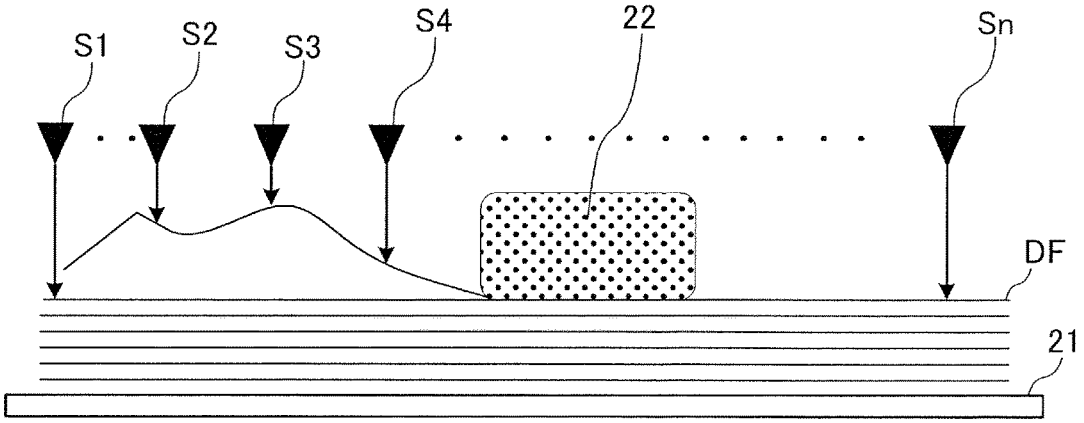
FIG. 10B is a side view illustrating a document being folded and causing a lift and seen from the sheet feeding direction.
Figure 11B:
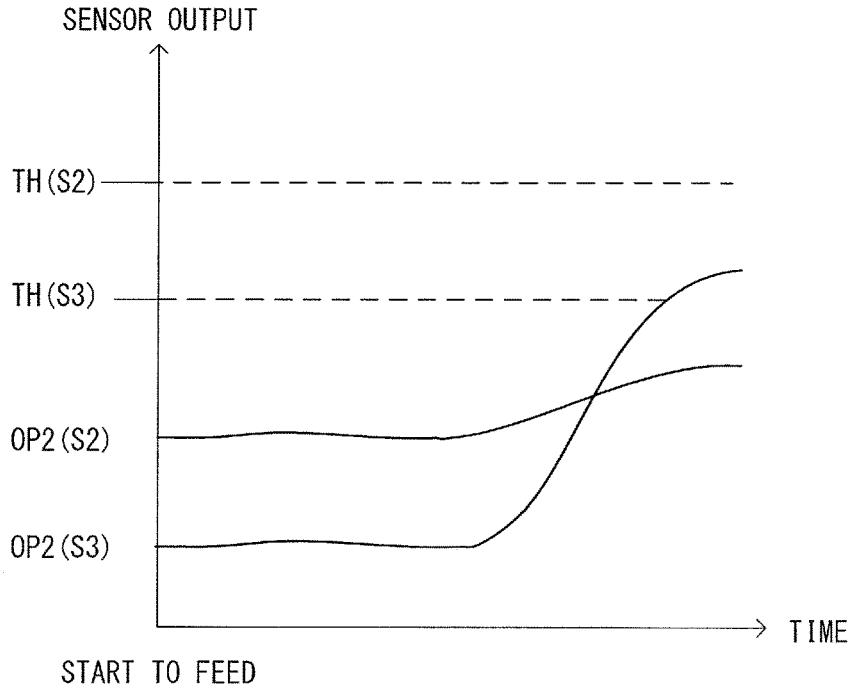
FIG. 11B is a graph indicating an output of the height detecting sensor in feeding the folded document.

If the folded document DF is fed by the pickup roller 22, the folded document causes a lift at the detection position of the height detecting sensor S3 as illustrated in FIG. 10B for example. Then, outputs OP2(S2) and OP2(S3) of the height detecting sensors S2 and S3 in feeding the document are indicated as illustrated in FIG. 11B. An output OP2(S3) of the height detecting sensor S3 increases as the folded document DF is fed further. The output OP2(S2) of the height detecting sensor S2 adjacent the height detecting sensor S3 does not change as much as the output of the height detecting sensor S3 even if the folded document DF is fed further.

Then, if the output OP2(S3) of the height detecting sensor S3 exceeds the threshold value TH(S3), the CPU 81 judges that the bound document is being fed and stops feeding the document. It is possible to detect the height positions of the document at the respective widthwise positions corresponding to the height detecting sensors S1 through Sn because the height detecting sensors S1 through Sn are disposed so as to overlap with the stacking surface 21*a* of the stacking tray 21 seen from the height direction. Then, because the threshold values are set individually for the height detecting sensors S1 through Sn, it is possible to detect the lift even if the lift occurs at a place different from a fold and a curl in feeding the document. That is, it is possible to reliably detect the bound document and to prevent the document from being torn or jammed regardless of a shape and a position of the document before feeding the document.

Next, while a second embodiment of the present disclosure will be described, a document is judged to be a bound document not only by the detection result of one height detecting sensor but also by detection results of a plurality of adjacent detection sensors in the second embodiment. Therefore, the same configurations of the present embodiment with those of the first embodiment will not be drawn or will be described by denoting the same reference numerals in the following drawings.

Figure 12:
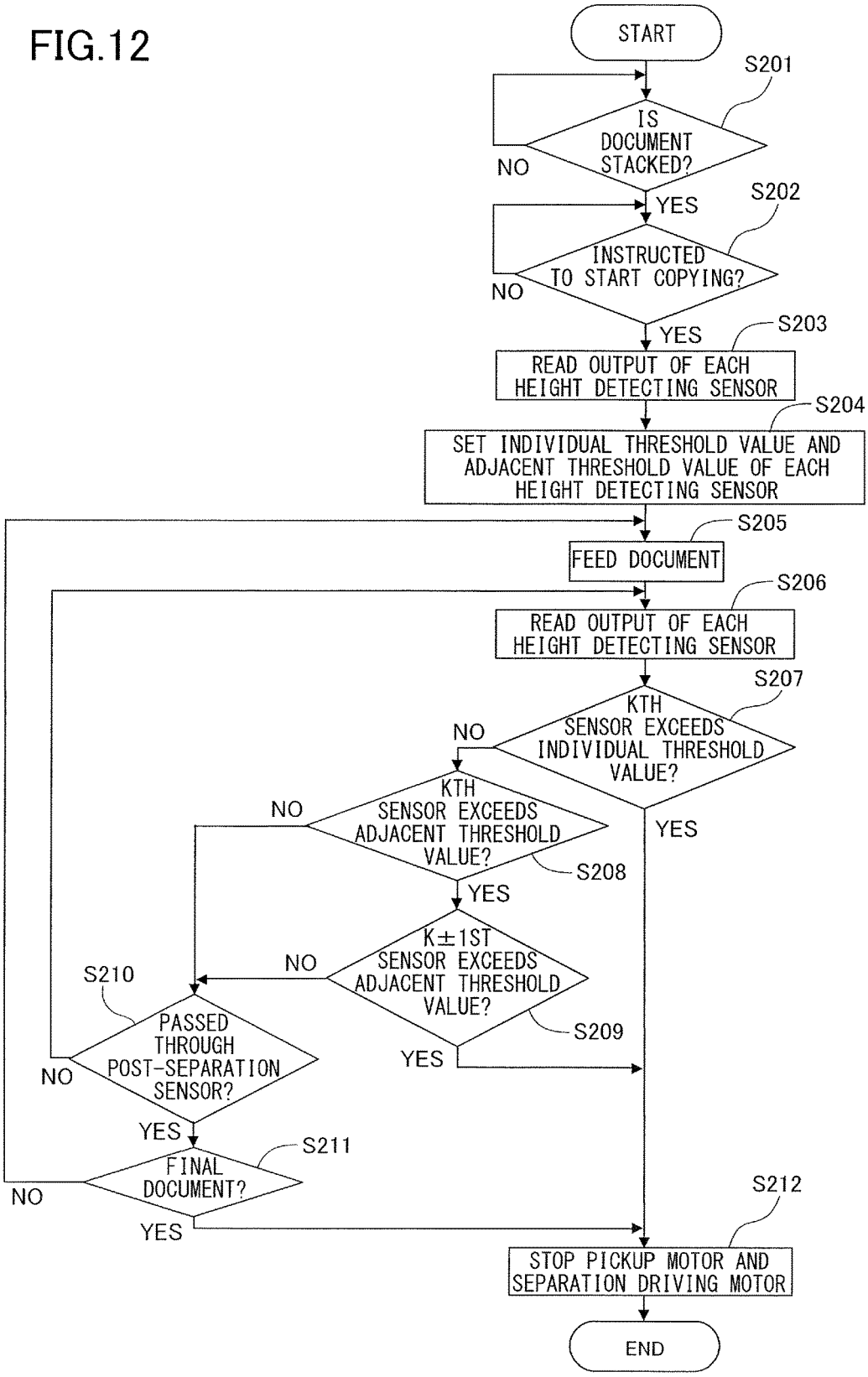
FIG. 12 is a flowchart illustrating a copying operation of a second embodiment.

While a copying job in feeding a bound document will be described along with a flowchart illustrated in FIG. 12, description of Steps S201 through S203 will be omitted here because they are the same with Steps S101 through S103 described with reference to FIG. 6. The CPU 81 sets individual threshold values TH1 (S1) through TH1 (Sn) for the respective height detecting sensors S1 through Sn by adding the predetermined variation $\alpha$ stored in the memory 82 to outputs OP1 (S1) through OP1 (Sn) of the respective height detecting sensors S1 through Sn before feeding the document. The CPU 81 also adds a predetermined variation $\beta$ stored in the memory 82 to the outputs OP1 (S1) through OP1 (Sn) to set adjacent threshold values TH2 (S1) through TH2 (Sn) for the respective height detecting sensors S1 through Sn in Step S204. Here, the variation β is smaller than the variation α, i.e., β<α.

Next, the CPU 81 feeds the document D by the pickup roller 22 in Step S205 and reads the outputs OP2 (S1) through OP2 (Sn) in feeding the document of the respective height detecting sensors S1 through Sn in Step S206. Then, the CPU 81 judges whether anyone the outputs OP2 (S1) through OP2 (Sn) exceeds the individual threshold values TH1 (S1) through TH1 (Sn) of the respective corresponding height detecting sensors in Step S207. It is noted that while the following description will be made by noticing on a $k^{th}$ height detecting sensor Sk from an end in a width direction and a height detecting sensor Sk±1 adjacent the height detecting sensor Sk, the height detecting sensor Sk is an arbitrary height detecting sensor among the plurality of height detecting sensors.

In a case where the output OP2 (Sk) of the height detecting sensor Sk in feeding the document exceeds the individual threshold value TH1 (Sk), i.e., Yes in Step S207, the CPU 81 judges that a bound document is being fed similarly to the first embodiment. That is, in a case where a variation of a height position detected by the height detecting sensor Sk before feeding the document and in feeding the document exceeds the variation α, the CPU 81 judges that the bound document is being fed. Then, the CPU 81 stops the pickup motor 84 and the separation driving motor 85 to stop feeding the document in Step S212.

Figure 13:
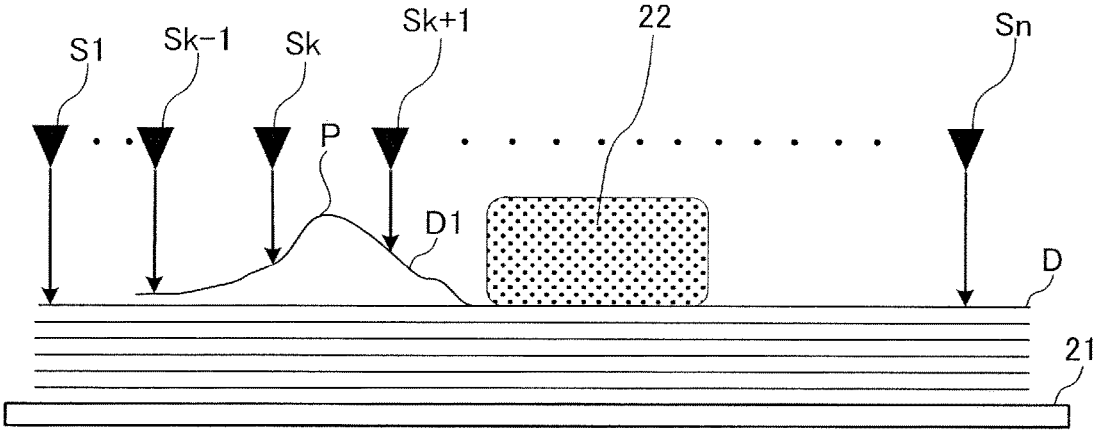
FIG. 13 is a side view illustrating a document causing a lift between sensors and seen from the sheet feeding direction.
Figure 14A:
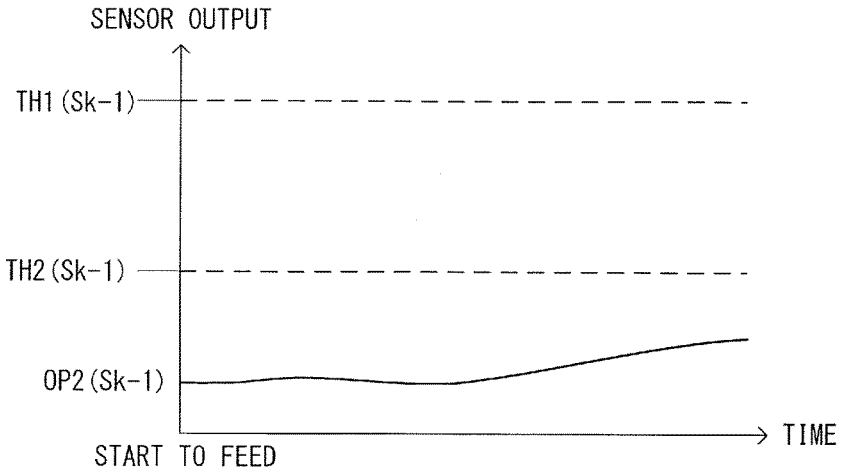
FIG. 14A is a graph indicating an output of a Sk−1$^{st}$ height detecting sensor.
Figure 14B:
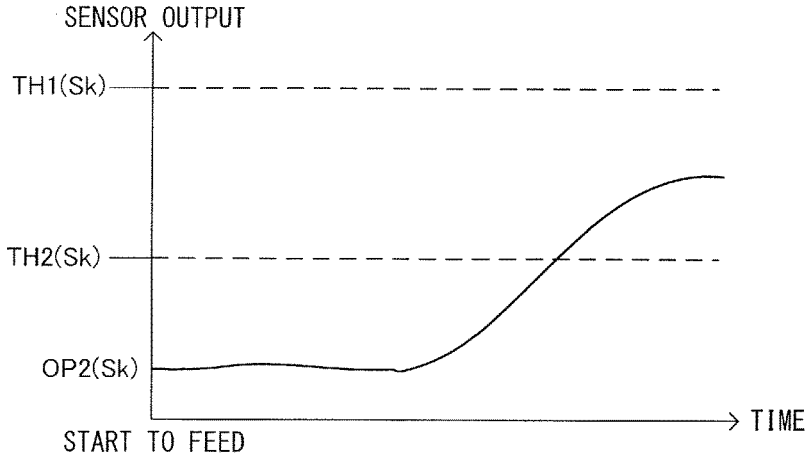
FIG. 14B is a graph indicating an output of a Sk$^{th}$ height detecting sensor.
Figure 14C:
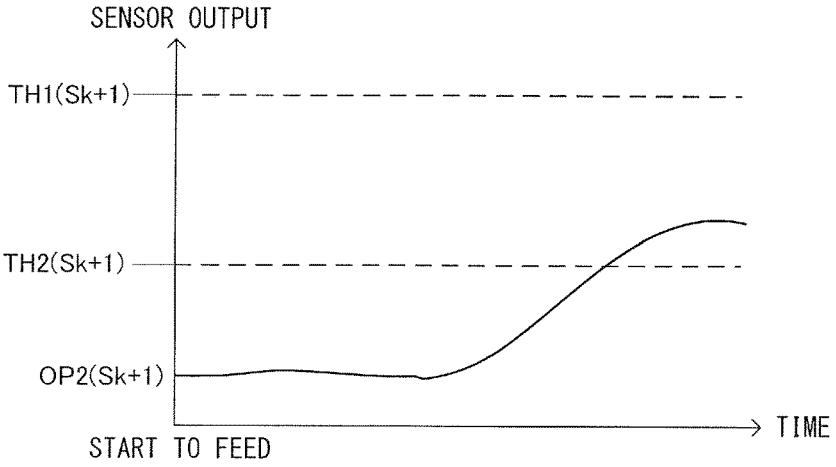
FIG. 14C is a graph indicating an output of a Sk−1$^{st}$ height detecting sensor.

Here, an examination will be made on a case where the bound document D is fed, the first sheet D1, i.e., the uppermost sheet of the bound document D, is lifted up, and an apex P of the lift is formed between the height detecting sensor Sk and the height detecting sensor Sk+1 as illustrated in FIG. 13. At this time, sensor outputs of the height detecting sensors Sk−1, Sk and Sk+1 appear respectively as illustrated in FIGS. 14A through 14C. The output OP2 (Sk) of the height detecting sensor Sk does not exceed the individual threshold value TH1 (Sk) as illustrated in FIG. 14B in Step S207, so that the CPU advances the process to Step S208. It is noted that as illustrated in FIGS. 14A and 14C, the outputs OP2 (Sk−1) and OP2 (Sk+1) of the height detecting sensors Sk−1 and Sk+1 also do not exceed the respective individual threshold values TH1 (Sk−1) and TH1 (Sk+1) at this time.

Next, the CPU 81 judges whether the output OP2 (Sk) of the height detecting sensor Sk exceeds the adjacent threshold value TH2 (Sk) in Step S208. In a case where the output OP2 (S k) does not exceed the adjacent threshold value TH2 (Sk), i.e., No in Step S208, the CPU 81 advances the process to Step S210. In a case where the output OP2 (Sk) exceeds the adjacent threshold value TH2 (Sk), i.e., Yes in Step S208, the CPU 81 proceeds to Step S209. In Step S209, the CPU 81 judges whether the outputs OP2 (Sk−1) and OP2 (Sk+1) of the height detecting sensors Sk−1 and Sk+1 exceed the respective adjacent threshold values TH2 (Sk−1) and TH2 (Sk+1). It is noted that in a case where the detection sensor Sk is the detection sensor S1 or the detection sensor Sn located at widthwise outermost positions among the detection sensors S1 through Sn, the CPU 81 judges the adjacent threshold value only on the detection sensor S2 or the detection sensor Sn−1.

As illustrated in FIGS. 14A and 14C, although the output OP2 (Sk−1) of the height detecting sensor Sk−1 does not exceed the adjacent threshold value TH2 (Sk−1), the output OP2 (Sk+1) of the height detecting sensor Sk+1 exceeds the adjacent threshold values TH2 (Sk+1) in the present embodiment. Therefore, the CPU 81 advances the process to Step S212 and judges that the bound document is being fed. The CPU 81 stops the pickup motor 84 and the separation driving motor 85 to stop feeding the document in Step S212.

That is, in a case where the difference of the height positions of the document before feeding the document and in feeding the document exceeds the variation β both set in advances as the second height, the CPU 81 stops feeding the document. In other words, if a threshold value TH2 (Sk) is set as a third threshold value for the height detecting sensor Sk and a threshold value TH2 (Sk+1) is set as a fourth threshold value for the height detecting sensor Sk+1 for example, the CPU 81 judges a document as a bound document in a case where both of the height detecting sensors Sk and Sk+1 detect height positions exceeding the respective threshold values TH2 (Sk) and TH2 (Sk+1).

In a case where the outputs OP2 (Sk−1) and OP2 (Sk+1) of the height detecting sensors Sk−1 and Sk+1 do not exceed the adjacent threshold values TH2 (Sk−1) and TH2 (Sk+1), i.e., No in Step S209, the CPU 81 advances the process to Step S210. In Step S210, the CPU 81 judges whether the leading edge of the fed document D has passed through the post-separation sensor S22, and repeats the process of Steps S206 through S209 if the leading edge of the document D has not passes through the post-separation sensor S22.

In a case where the leading edge of the fed document D has passed through the post-separation sensor S22, i.e., Yes in Step S210, the CPU 81 judges whether the fed document D is a final document of the copying job in Step S211. If the fed document D is not the final document, the CPU 81 returns the process to Step S205 and advances the process to Step S212 in a case where the document is the final document. Then, the CPU 81 stops the pickup motor 84 and the separation driving motor 85 to stop feeding the document in Step S212.

Thus, the document can be judged to be the bound document not only by the individual threshold value of each height detecting sensor but also by detecting whether the outputs of the both adjacent height detecting sensors exceed the adjacent threshold values. That is, it is possible to detect the bound document also in a case where the lift of the document occurs between the two adjacent height detecting sensors and where the outputs of the both height detecting sensors do not exceed the individual threshold value. Therefore, it is possible to detect the lift of the bound document and to lower the cost even if a distance between the sensors is relatively widened and a number of the sensors is reduced.

Third Embodiment

Next, a third embodiment of the present disclosure will be described. The pickup roller is elevated/lowered and is turned ON/OFF based on a position of a document being fed in the third embodiment. Therefore, the same configurations of the present embodiment with those of the first embodiment will not be drawn or will be described by denoting the same reference numerals in the following drawings. It is necessary to set the threshold value for each of the fed document to detect the bound document in the present embodiment including the first and second embodiments. Then, the document has to be stopped, without being fed, in setting the threshold value.

Figure 15:
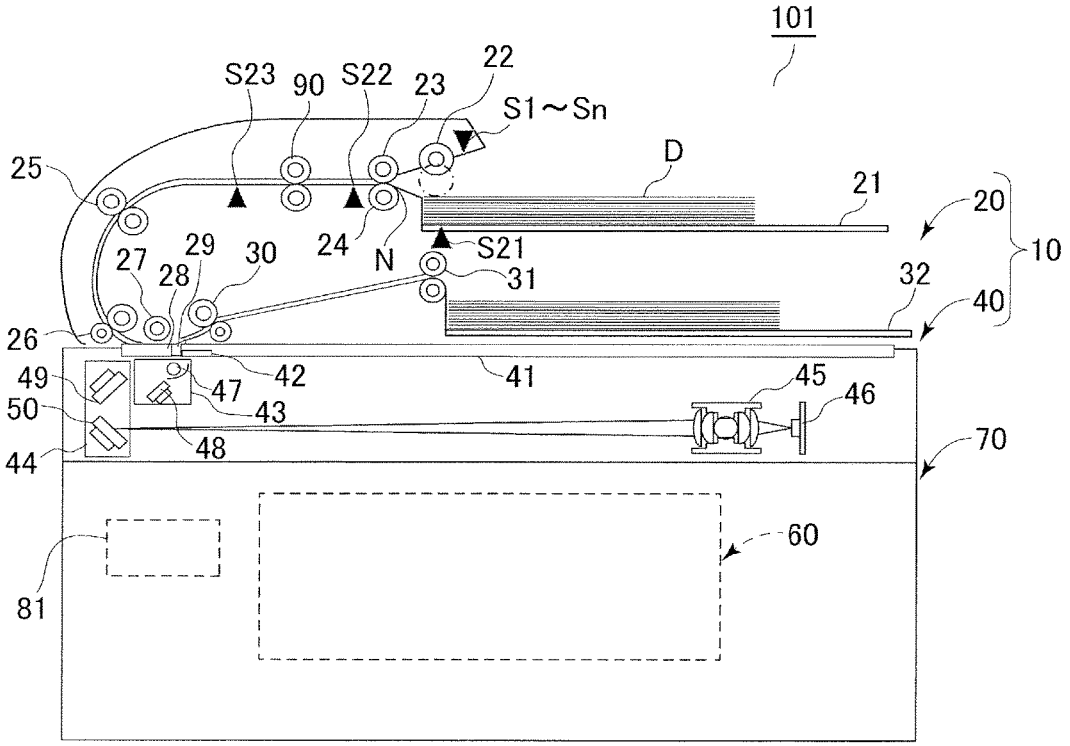
FIG. 15 is a schematic diagram illustrating an overall configuration of a printer of a third embodiment.
Figure 16:
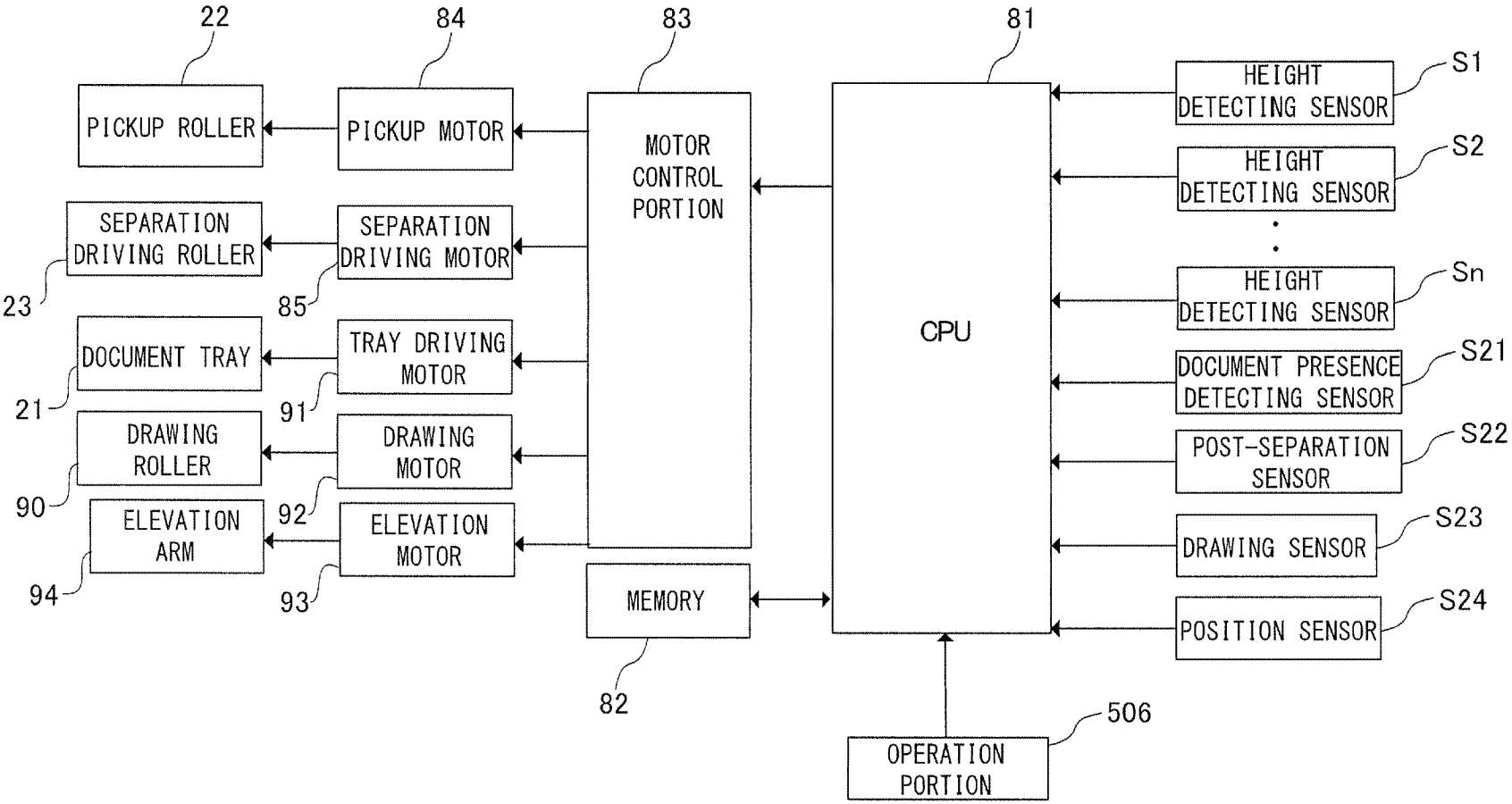
FIG. 16 is a control block diagram of the printer of the third embodiment.

As illustrated in FIG. 15, the printer 101 includes a drawing roller 90 and a drawing sensor S23 downstream of the post-separation sensor S22 in the sheet feeding direction. Still further, as illustrated in FIG. 16, the height detecting sensors S1 through Sn, the document presence detecting sensor S21, the post-separation sensor S22, the drawing sensor S23, and the position sensor S24 are connected to the input side of the CPU 81. The drawing sensor S23 detects positions of leading and trailing edges of the fed document D. The position sensor S24 detects a position in the height direction of the pickup roller 22.

Still further, a pickup motor 84, a separation driving motor 85, a tray driving motor 91, a drawing motor 92, and an elevation motor 93 are connected to the output side of the CPU 81 through a motor control portion 83. The tray driving motor 91 elevates a downstream side of the stacking tray 21 centering on a pivot shaft not illustrated. The drawing motor 92 rotates or stops the drawing roller 90. The elevation motor 93 elevates an elevation arm 94 configured to elevatably support the pickup roller 22. It is noted that the drive of the pickup motor 84 is transmitted to the pickup roller 22 and to the separation driving roller 23.

Next, an operation in feeding a document and timing for setting a threshold value of the printer 101 will be described. At first, as soon as the CPU 81 detects, through the document presence detecting sensor S21, that the user has stacked the document D on the stacking tray 21, the CPU 81 drives the tray driving motor 91 to raise the stacking tray 21. Then, an upper surface of the document D abuts with the pickup roller 22 which has been restrained from dropping by a stopper not illustrated. If the stacking tray 21 is raised further, the pickup roller 22 also is raised by being pushed by the document D.

As soon as the position sensor S24 detects that the pickup roller 22 is raised to a feed position, the CPU stops the tray driving motor 91. At this time, in a case where the user instructs to start copying by pressing a copy button or the like before the pickup roller 22 rises to the feed position, the threshold values of the respective height detecting sensors S1 through Sn are set by waiting until when the pickup roller 22 is raised to the feed position. Because the procedure for setting the threshold values of the respective height detecting sensors S1 through Sn has been described in Steps S103 and S104 in FIG. 6, the description thereof will be omitted here. In a case where the user instructs to start copying after when the pickup roller 22 has been raised to the feed position, the threshold values of the height detecting sensors S1 through Sn are set right after when the instruction to start copying is made. That is, the timing for setting the threshold values of the height detecting sensors S1 through Sn is the time when the pickup roller 22 abuts with the document D and the pickup roller 22 is stopped.

Figure 17:
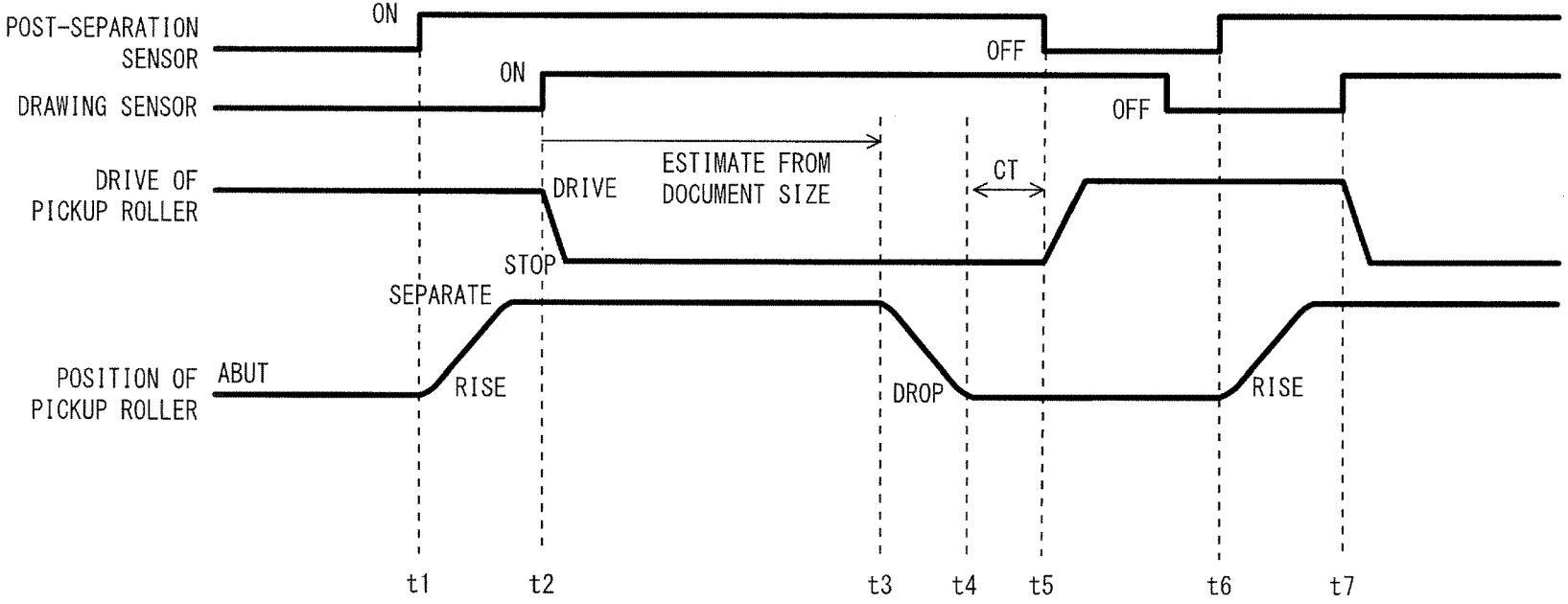
FIG. 17 is a timing chart indicating a threshold value setting timing.

Then, as soon as the threshold values of the respective height detecting sensors S1 through Sn are set, the CPU 81 drives the pickup motor 84 to feed the document D by the pickup roller 22. Elevation/lowering and ON/OFF of the drive of the pickup roller 22 after starting to feed the document D will be described below along a timing chart in FIG. 17. In FIG. 17, a case where the post-separation sensor S22 and the drawing sensor S23 detect the document D will be indicated as 'ON' and a case where they do not detect the document D as 'OFF'.

As illustrated in FIG. 17, as soon as the post-separation sensor S22 detects the leading edge of the fed document D, the CPU 81 drives the elevation motor 93 to raise the elevation arm 94 at time t1. Thereby, the pickup roller 22 separates from the document D on the stacking tray 21, and the document D is not fed. The elevation arm 94 stops at a predetermined height. As soon as the drawing sensor S23 detects the leading edge of the document D at time t2, the CPU 81 stops to drive the pickup motor 84. Thereby, the pickup roller 22 and the separation driving roller 23 stop to drive, and the fed document D is conveyed by the drawing roller 90.

Then, the CPU 81 seeks a time t3 when the pickup roller 22 is lowered based on a size or a length in the sheet feeding direction in particular of the fed document D. That is, the CPU 81 seeks a time from when the leading edge of the document D is detected by the drawing sensor S23 until a trailing edge of the fed document passes through under the pickup roller 22. It is noted that the size of the document D being fed is judged by a sensor not illustrated and configured to detect the position of the document D in the sheet feeding direction of the stacking tray 21.

The pickup roller 22 starts to drop at the time t3 and abuts with an upper surface of a second document D at time t4. At this time, the pickup roller 22 is not rotated. Then, as soon as the post-separation sensor S22 detects the trailing edge of the document D at time t5, the CPU 81 drives the pickup motor 84 to feed the second document by the pickup roller 22. The period from the time t1 to the time t5 is one pattern until when the second document is fed from when the first document is fed, and controls at times t6 and t7 indicated in FIG. 17 are same with the controls at times t1 and t2.

Timing for setting a threshold value for the second document and thereafter is a period CT between the times t4 and t5. During this period CT, the pickup roller abuts with the document D and is stopped. It is possible to restrain productivity of the printer 101 from dropping and to detect the bound document accurately by setting the threshold values of the respective height detecting sensors during this period CT.

Fourth Embodiment

Next, while a fourth embodiment of the present disclosure will be described below, the fourth embodiment is different from the first embodiment only in that configurations of the height detecting sensors are different. Therefore, the same configurations of the present embodiment with those of the first embodiment will not be drawn or will be described by denoting the same reference numerals in the following drawings.

Figure 18A:
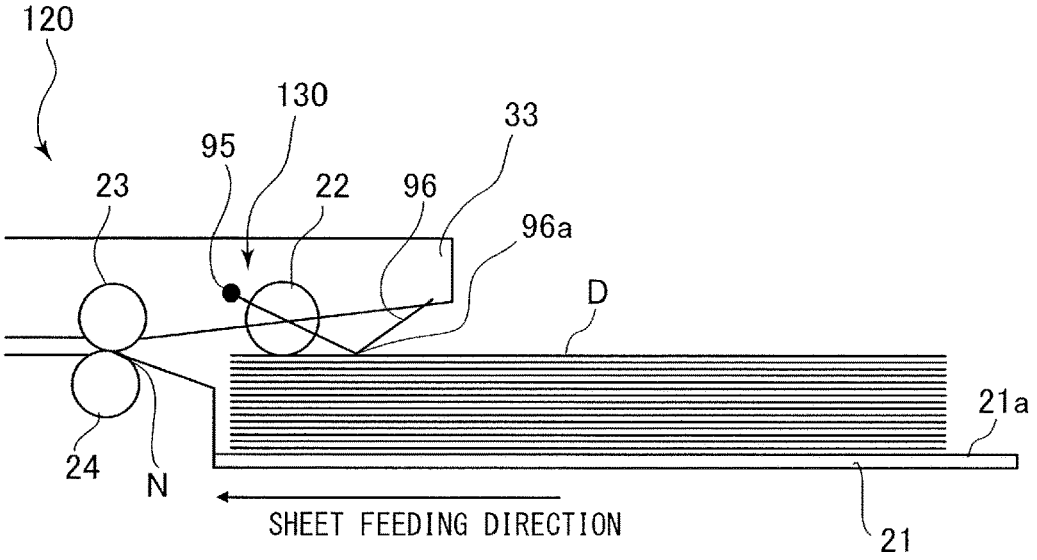
FIG. 18A is a side view illustrating a height detecting sensor of a fourth embodiment in a condition in which a regular document is stacked.
Figure 19:
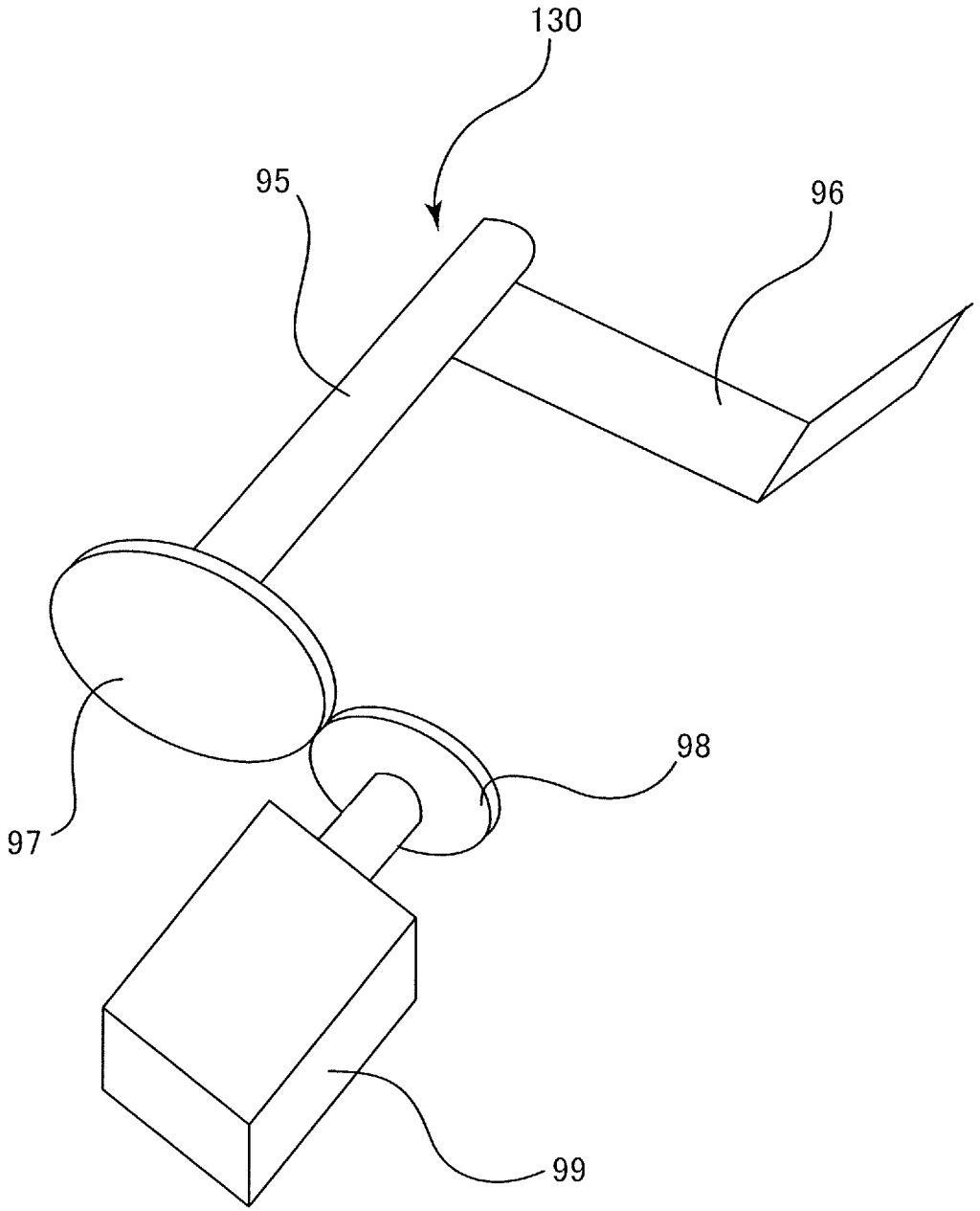
FIG. 19 is a perspective view illustrating a configuration of a height detecting sensor.

As illustrated in FIGS. 18A and 19, a plurality of height detecting sensors 130 is provided in the frame 33 of the ADF 120. Similarly to the height detecting sensors S1 through Sn of the first embodiment, the plurality of height detecting sensors 130 is disposed above the stacking tray 21 and at positions different from each other in the width direction. More specifically, the plurality of height detecting sensors 130 is disposed so as to overlap with the stacking surface 21*a* of the stacking tray 21 in view of the height direction orthogonal to the stacking surface 21*a*.

As illustrated in FIG. 19, each of the height detecting sensors 130 includes a lever 96 serving as a turning portion configured to turn following an uppermost document stacked on the stacking tray 21 and a rotary volume 99 serving as a turn detecting portion configured to detect an angle of turn of the lever 96. An abutment portion 96*a* configured to abut with the document D of each lever 96 is located at positions different from each other in the width direction. A first gear 98 is rotably connected with the rotary volume 99, and a second gear 97 is meshed with the first gear 98. The second gear 97 is fixed to a shaft 95, and the lever 96 is fixed to the shaft 95. Therefore, electric resistance of the rotary volume 99 varies as the lever 96 turns following the uppermost document, and voltage detected by the CPU 81 varies. It is possible to detect the height position of the uppermost document by the variation of the voltage. That is, the height detecting sensor 130 transmits a signal generated based on a degree of the angle of turn of the lever 96 to the CPU 81.

Figure 18B:
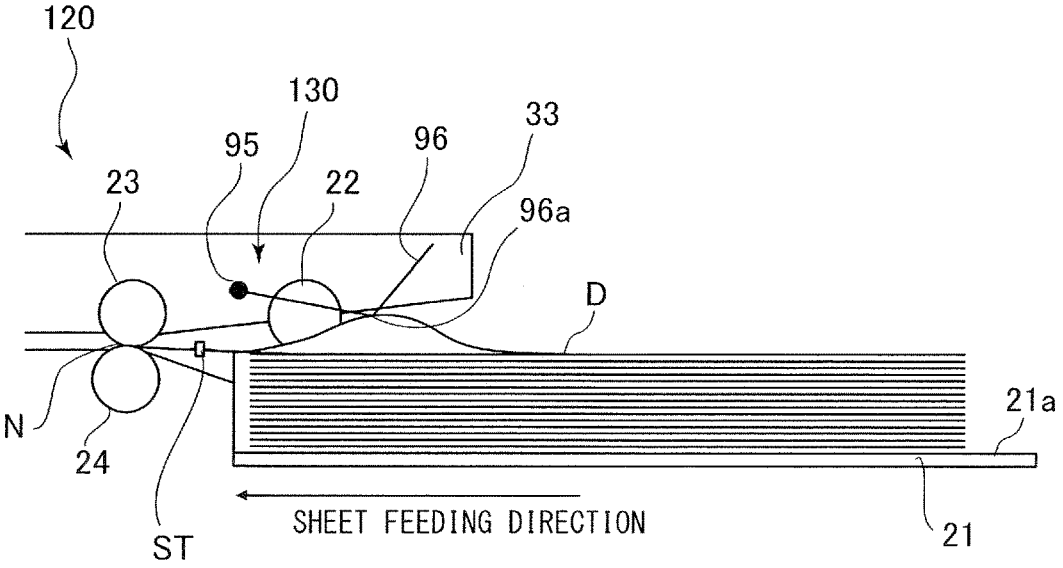
FIG. 18B is a side view illustrating the height detecting sensor of the fourth embodiment in a condition in which a bound document is fed.

In a case where the uppermost document of the bound document bound by a staple ST is fed by the pickup roller 22 as illustrated in FIG. 18B, the uppermost document is lifted up and the height position of the document is partially raised up. Each lever 96 of the plurality of height detecting sensors 130 abuts with the upper surface of the document at a position different from each other in the width direction. Therefore, the lever abutting with the lifted part of the document turns upward, and the lever abutting with non-lifted part is not turned. Then, in a case where a variation of the height positions before feeding the document and in feeding the document detected by either lever exceeds a predetermined variation, the CPU 81 judges that the document being fed is a bound document.

As described above, according to the present embodiment, the height position of the document is detected not by a quantity of light of reflected light from the document but in accordance to the angle of turn of the lever. This arrangement makes it possible to detect the height position of the document stably regardless of a type and grammage of the document.

Fifth Embodiment

Next, a fifth embodiment of the present disclosure will be described. The fifth embodiment is different from the first embodiment in that the detection method of the height detecting sensor and the flowchart are different. The same configurations of the present embodiment with those of the first embodiment will not be drawn or will be described by denoting by the same reference numerals in the following drawings.

Figure 20A:
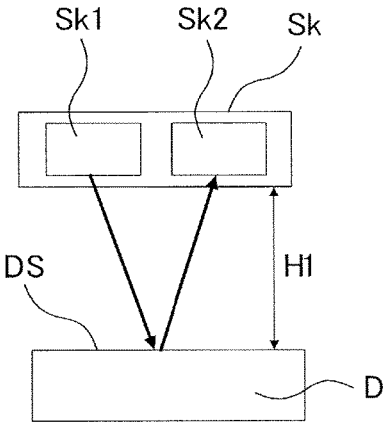
FIG. 20A is a diagrammatic view illustrating a height detecting sensor of a fifth embodiment which is disposed at a position close to a document surface.
Figure 20B:
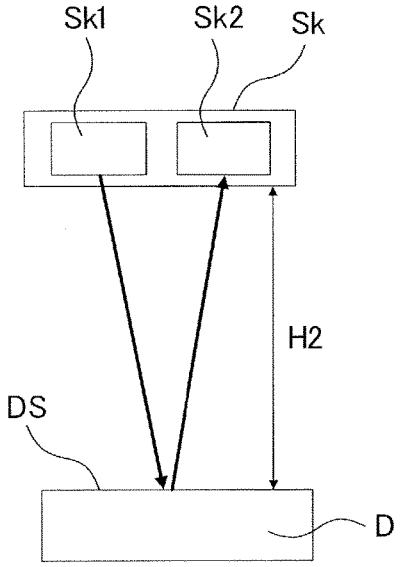
FIG. 20B is a diagrammatic view illustrating a height detecting sensor which is disposed at a position distant from the document surface.

As illustrated in FIGS. 20A and 20B, the height detecting sensor Sk includes a light emitting portion Sk1 configured to irradiate an uppermost document D stacked on the stacking tray 21 with light and a photo-sensing portion Sk2 configured to receive the light reflected by the document D.

Figure 20C:
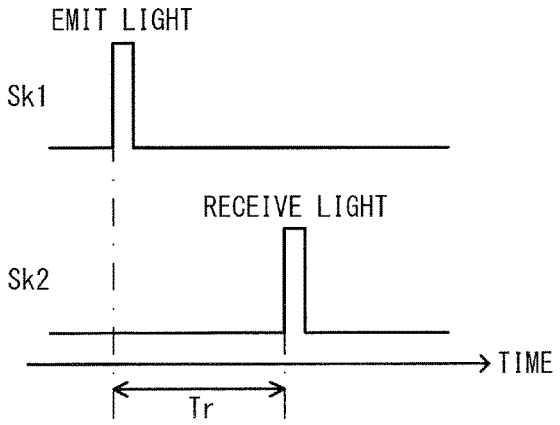
FIG. 20C is a graph indicating a time until when a photo-sensing portion receives a light beam irradiated from a light emitting portion and reflected by the document surface.
Figure 20D:
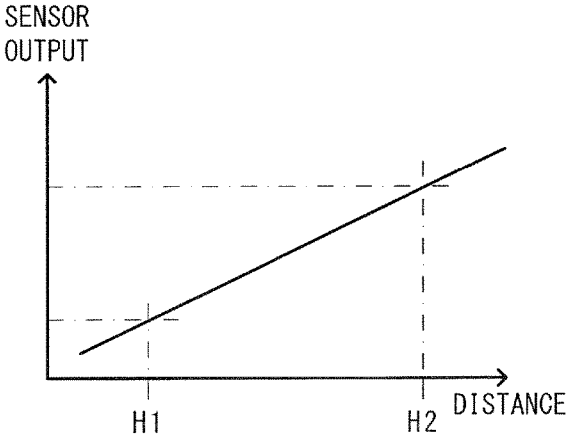
FIG. 20D is a graph indicating a relationship between the distance between the document surface and the height detecting sensor and the sensor output.

As illustrated in FIG. 20C, the height detecting sensor Sk outputs a signal based on a time Tr from when the light emitting portion Sk1 irradiates the light and until when the light irradiated from the light emitting portion Sk1 and reflected by the document surface DS is received by the photo-sensing portion Sk2. In a case where a distance H1 between the document surface DS of the document D and the height detecting sensor Sk is relatively small as illustrated in FIG. 20A, a time Tr from when the light emitting portion Sk1 irradiates the light and until when the light irradiated from the light emitting portion Sk1 and reflected by the document surface DS is received by the photo-sensing portion Sk2 is short. In a case where a distance H2 (H2>H1) between the document surface DS of the document D and the height detecting sensor Sk1 is relatively large as illustrated in FIG. 20B, a time Tr from when the light emitting portion Sk1 irradiates the light and until when the light irradiated from the light emitting portion Sk1 and reflected by the document surface DS is received by the photo-sensing portion Sk2 is long. That is, the height detecting sensor Sk transmits a signal based on the time Tr to the CPU 81 (see FIG. 5). FIG. 20D is a graph indicating the distance between the document surface DS and the height detecting sensor Sk and the sensor output. That is, the longer the distance between the document surface DS of the document D and the height detecting sensor Sk1, the greater the output (sensor output) of the signal transmitted to the CPU 81. Corresponding to the sensor output transmitted from the height detecting sensor Sk, the CPU 81 can detect the height position which is a position in the height direction of the document at a detection position.

Figure 21:
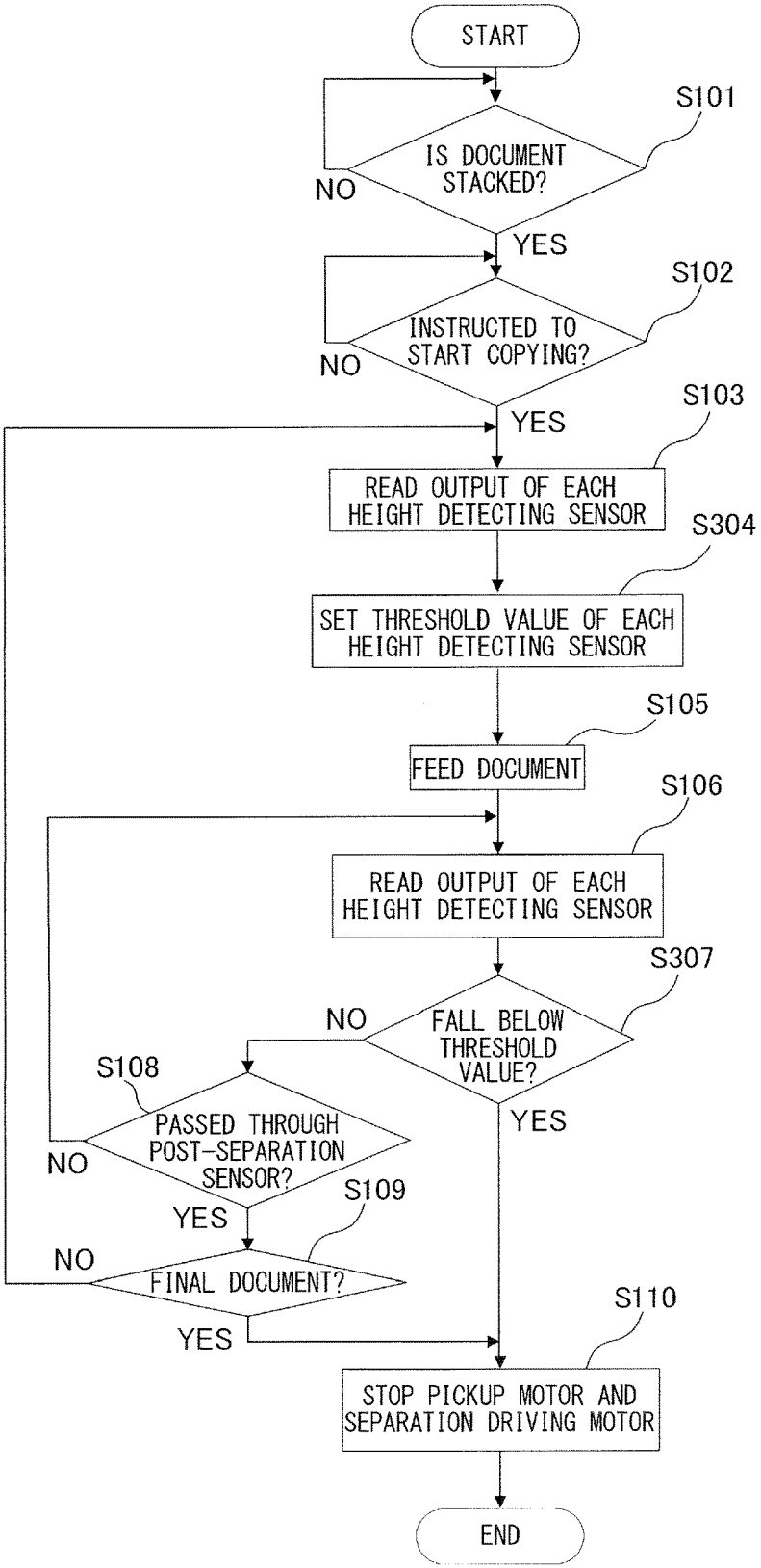
FIG. 21 is a flowchart illustrating a copying operation of a printer of the fifth embodiment.

Next, a flowchart of an operation in feeding a document will be described with reference to FIG. 21. Although the flowchart is basically the same with the flowchart in FIG. 6 of the first embodiment, Step S104 in FIG. 6 is replaced with Step S304 in FIG. 21. Step S107 is also replaced with Step S307 in FIG. 21.

In Step S304, an output before feeding the document of an arbitrary height detecting sensor Sk will be set as an output OP1 (Sk), an output in feeding the document will be set as an output OP2 (Sk), and a threshold value of the height detecting sensor Sk will be set as a threshold value TH (Sk). The CPU 81 subtracts a predetermined variation $\alpha$ stored in the memory 82 from the outputs OP1 (S1) through OP1 (Sn) of the respective height detecting sensors S1 through Sn before feeding the document to set threshold values TH (S1) through TH (Sn) for the respective height detecting sensors S1 through Sn.

Figure 22A:
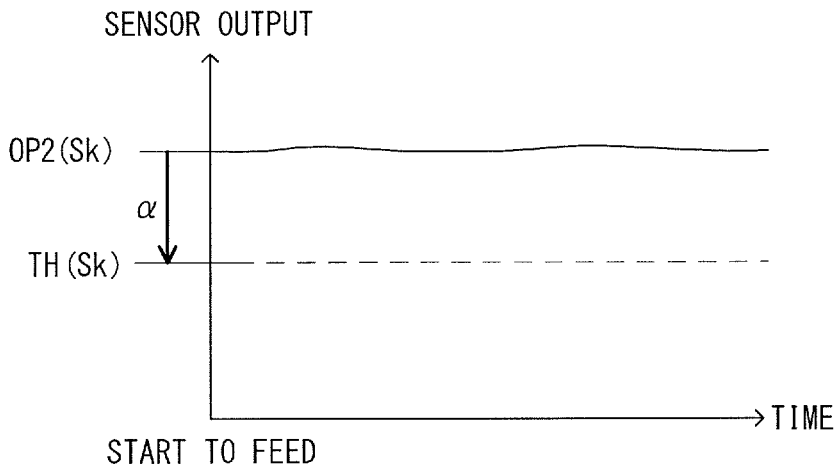
FIG. 22A is a graph indicating an output of a height detecting sensor in feeding a regular document.

In Step S307, the CPU 81 judges whether the output of the height detecting sensor falls below the threshold value TH. At this time, as illustrated in FIGS. 7A through 8A, no lift characteristic to a document of a bound document occurs in a case where a regular document, i.e., non-bound document, is fed. Due to that, as illustrated in FIG. 22A, an output of the output OP2 (Sk) of the height detecting sensor Sk in feeding the document is kept high. Accordingly, none of the outputs OP2 (S1) through OP2 (Sn) falls below the respectively corresponding threshold values TH (S1) through TH (Sn) when the regular document is fed.

Figure 22B:
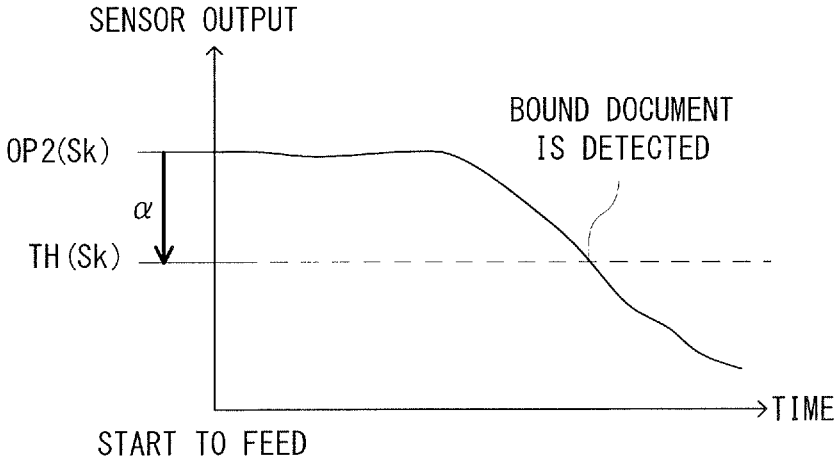
FIG. 22B is a graph indicating an output of the height detecting sensor in feeding a bound document.

Next, in a case where the bound document is fed as illustrated in FIGS. 7B and 8B, the first sheet D1, i.e., the uppermost document D, is lifted up as the document D is fed and a height position of the first sheet D1 partially is raised. Due to that, the output OP2 (Sk) of the height detecting sensor Sk drops as the bound document is fed as illustrated in FIG. 22B. The CPU 81 judges whether anyone of the outputs OP2 (S1) through OP2 (Sn) of the respective height detecting sensors in feeding the document falls below the threshold values TH (S1) through TH (Sn) of the respectively corresponding height detecting sensors.

Figure 23A:
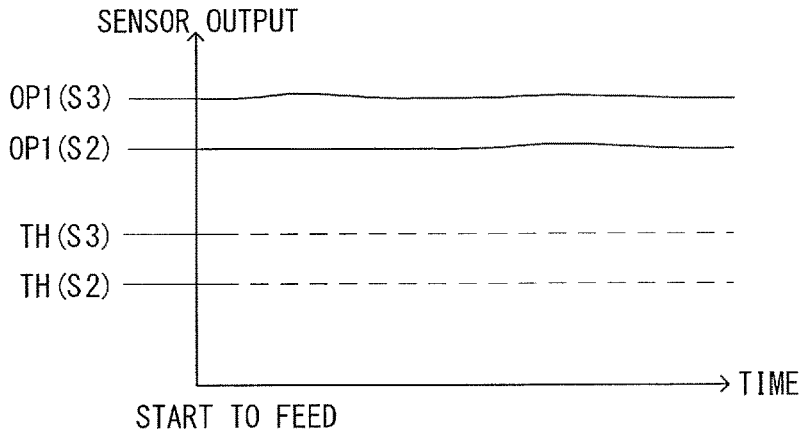
FIG. 23A is a graph indicating an output of the height detecting sensor before feeding a folded document.

Similarly to the first embodiment, it is possible to deal with a case where a first document of the bound document is a folded document whose end portion is folded or a curled document whose end portion is curled for example also in the present embodiment. For instance, a case of feeding a folded document DF whose widthwise end portion is folded as illustrated in FIG. 10A will be examined. The fold of the folded document DF is formed at the detection position of the height detecting sensor S2. Therefore, outputs OP1 (S2) and OP1 (S3) of the height detecting sensors S2 and S3 before feeding the document are indicated as illustrated in FIG. 23A. The output OP1 (S2) of the height detecting sensor S2 is lower than the output OP1 (S3) of the height detecting sensor S3. The threshold values TH (S2) and TH (S3) are set respectively based on the outputs OP1 (S2) and OP1 (S3) of the height detecting sensors S2 and S3. A difference between the threshold values TH (S2) and TH (S3) corresponds to a difference between the outputs OP1 (S2) and OP1 (S3).

Figure 23B:
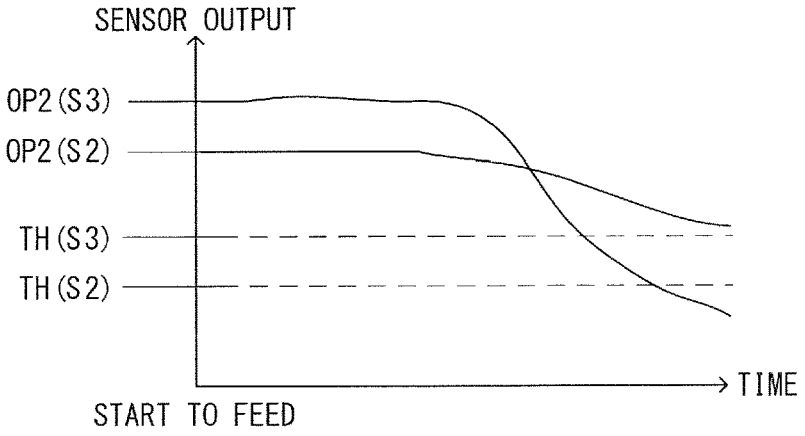
FIG. 23B is a graph indicating an output of the height detecting sensor in which the folded document is fed.

If the folded document DF is fed by the pickup roller 22, the folded document causes a lift at the detection position of the height detecting sensor S3 as illustrated in FIG. 10B for example. Then, outputs OP2 (S2) and OP2 (S3) of the height detecting sensors S2 and S3 in feeding the document are indicated as illustrated in FIG. 23B. The output OP2 (S3) of the height detecting sensor S3 decreases as the folded document DF is fed further. The output OP2 (S2) of the height detecting sensor S2 adjacent the height detecting sensor S3 does not charge so much as the output of the height detecting sensor S3 even if the folded document DF is fed further.

Then, if the output OP2(S3) of the height detecting sensor S3 falls below the threshold value TH(S3), the CPU 81 judges that the bound document is being fed and stops feeding the document. It is liable to be influenced by an image formed on the document D in the case where the distance between the document surface DS of the document D and the height detecting sensor Sk1 is detected based on a quantity of light detected by the height detecting sensor like the first embodiment. For instance, there is a possibility that a difference of quantities of light becomes large between an image such as a solid black image that hardly reflects light and an image such as a solid white image that is liable to reflect light. The case of the present embodiment is less influenced by the image formed on the document D because the distance between the document surface DS of the document D and the height detecting sensor Sk is detected based on the time from when the light emitting portion Sk1 irradiates the light and until the light irradiated from the light emitting portion Sk1 of the height detecting sensor Sk arrives at the photo-sensing portion Sk2.

Sixth Embodiment

Next, a sixth embodiment of the present disclosure will be described. The sixth embodiment is different from the second embodiment in that the detection method of the height detecting sensor and the flowchart are different. Therefore, the same configurations of the present embodiment with those of the second embodiment will not be drawn or will be described by denoting by the same reference numerals in the following drawings.

Similarly to the fifth embodiment, the height detecting sensor of the sixth embodiment detects the distance between the document surface DS of the document D and the height detecting sensor Sk based on a time from when the light emitting portion Sk1 irradiates the light and until when the light irradiated from the light emitting portion Sk1 arrives at the photo-sensing portion Sk2.

Figure 24:
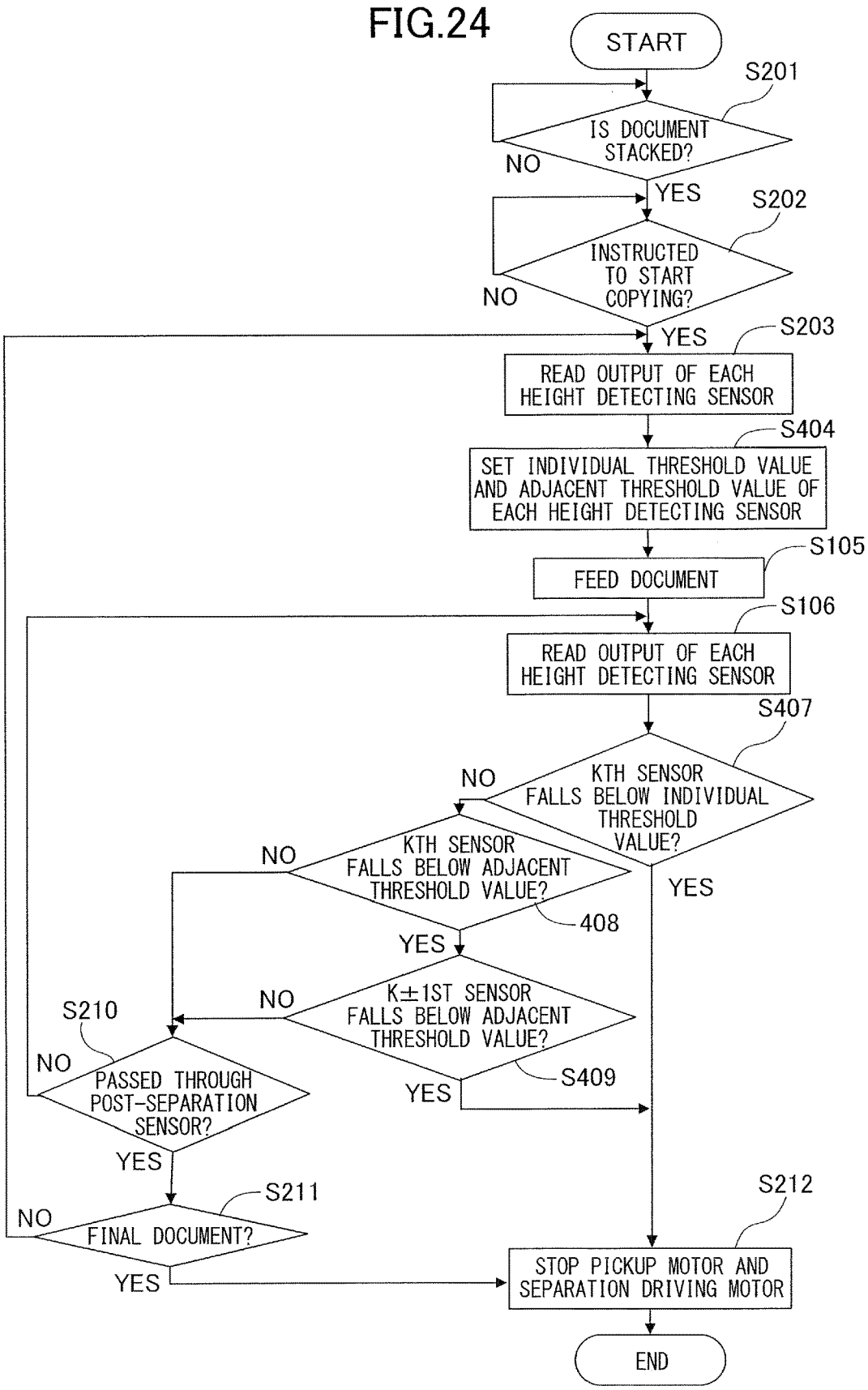
FIG. 24 is a flowchart illustrating a copying operation of a printer of a sixth embodiment.

While the copying operation in feeding the bound document will be described below along a flowchart illustrated in FIG. 24, the flowchart is the same with the flowchart illustrated in FIG. 12 except of Step S404 and Steps S407 through S409. Accordingly, description of the same part of the flowcharts will be omitted here. In Step S404, the CPU 81 sets individual threshold values TH1 (S1) through TH1 (Sn) for the respective height detecting sensors S1 through Sn by subtracting the predetermined variation $\alpha$ stored in the memory 82 from outputs OP1 (S1) through OP1 (Sn) of the respective height detecting sensors S1 through Sn before feeding the document. The CPU 81 also subtracts the predetermined variation $\beta$ stored in the memory 82 from the outputs OP1 (S1) through OP1 (Sn) to set adjacent threshold values TH2 (S1) through TH2 (Sn) for the respective height detecting sensors S1 through Sn. Here, the variation $\beta$ is smaller than the variation $\alpha$, i.e., $\beta<\alpha$.

Then, the CPU 81 judges whether any one of the outputs OP2(S1) through OP2(Sn) falls below the individual threshold values TH1(S1) through TH1(Sn) of the respective corresponding height detecting sensors in Step S407. It is noted that while the following description will be made by noticing on a $k^{th}$ height detecting sensor Sk from an end in the width direction and a height detecting sensor Sk±1 adjacent the height detecting sensor Sk, the height detecting sensor Sk is an arbitrary height detecting sensor among the plurality of height detecting sensors.

In a case where the output OP2 (Sk) of the height detecting sensor Sk in feeding the document falls below the individual threshold value TH1 (Sk), i.e., Yes in Step S407, the CPU 81 judges that a bound document is being fed similarly to the second embodiment. That is, in a case where a variation of a height position detected by the height detecting sensor Sk before feeding the document and in feeding the document exceeds the variation $\alpha$, the CPU 81 judges that the bound document is being fed.

Figure 25A:
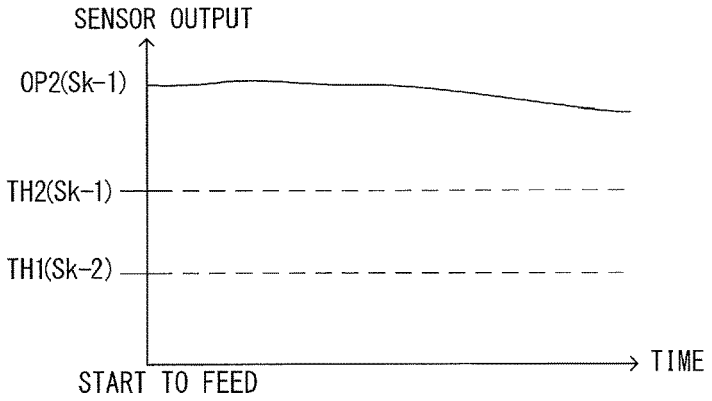
FIG. 25A is a graph indicating an output of a Sk−1$^{st}$ height detecting sensor.
Figure 25B:
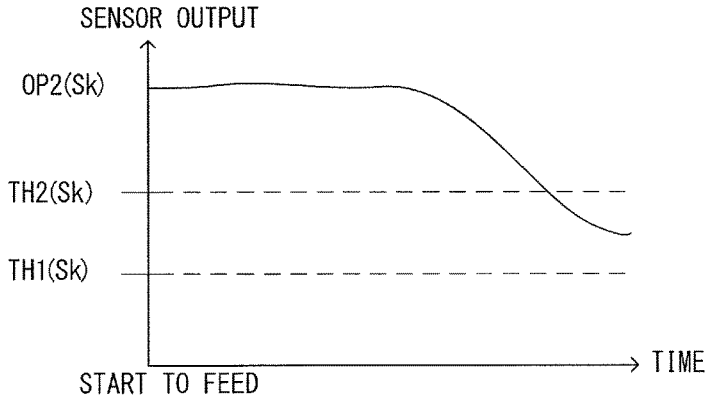
FIG. 25B is a graph indicating an output of a Sk$^{th}$ height detecting sensor.
Figure 25C:
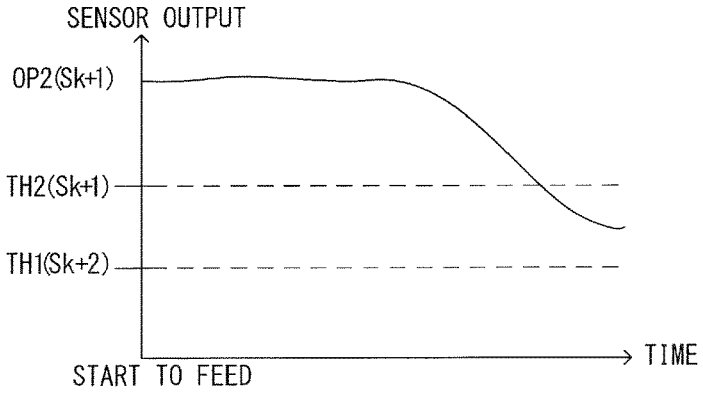
FIG. 25C is a graph indicating an output of a Sk+1$^{st}$ height detecting sensor.

Here, an embodiment in a case where the bound document D is fed, a first sheet D1, i.e., the uppermost sheet of the bound document D, is lifted up, and an apex P of the lift is formed between the height detecting sensor Sk and the height detecting sensor Sk+1 as illustrated in FIG. 13 will be examined. At this time, sensor outputs of the height detecting sensors Sk−1, Sk and Sk+1 appear respectively as illustrated in FIGS. 25A through 25C. The output OP2 (Sk) of the height detecting sensor Sk does not fall below the individual threshold value TH1 (Sk) as illustrated in FIG. 25B in Step S407, so that the CPU 81 advances the process to Step S408. It is noted that as illustrated in FIGS. 25A and 25C, the outputs OP2 (Sk−1) and OP2 (Sk+1) of the height detecting sensors Sk−1 and Sk+1 do not fall below the respective individual threshold values TH1 (Sk−1) and TH1 (Sk+1) at this time.

Next, the CPU 81 judges whether the output OP2 (Sk) of the height detecting sensor Sk falls below the adjacent threshold value TH2 (Sk) in Step S408. In a case where the output OP2 (Sk) does not fall below the adjacent threshold value TH2 (Sk), i.e., No in Step S408, the CPU 81 advances the process to Step S210. In a case where the output OP2 (Sk) falls below the adjacent threshold value TH2 (Sk), i.e., Yes in Step S408, the CPU 81 advances the process to Step S409. In Step S409, the CPU 81 judges whether the outputs OP2 (Sk−1) and OP2 (Sk+1) of the height detecting sensors Sk−1 and Sk+1 fall below the respective adjacent threshold values TH2 (Sk−1) and TH2 (Sk+1). It is noted that in a case where the detection sensor Sk is the detection sensor S1 or the detection sensor Sn located at widthwise outermost positions among the detection sensors S1 through Sn, the CPU 81 judges the adjacent threshold value only on the detection sensor S2 or the detection sensor Sn−1.

As illustrated in FIGS. 25A and 25C, although the output OP2 (Sk−1) of the height detecting sensor Sk−1 does not fall below the adjacent threshold value TH2 (Sk−1), the output OP2 (Sk+1) of the height detecting sensor Sk+1 falls below the adjacent threshold values TH2 (Sk+1) in the present embodiment. Therefore, the CPU 81 advances the process to Step S212 and judges that the bound document is being fed. The CPU 81 stops the pickup motor 84 and the separation driving motor 85 to stop feeding the document in Step S212.

That is, in a case where both of the differences of the height positions, detected by the height detecting sensors Sk and Sk+1, of the document before feeding the document and in feeding the document exceed the variations $\beta$ as the predetermined second value, the CPU 81 stops feeding the document. In other words, if a threshold value TH2 (Sk) is set as a third threshold value for the height detecting sensor Sk and a threshold value TH2 (Sk+1) is set as a fourth threshold value for the height detecting sensor Sk+1 for example, the CPU 81 judges a document as a bound document in a case where both of the height detecting sensors Sk and Sk+1 detect height positions falling below the respective threshold values TH2 (Sk) and TH2 (Sk+1).

In a case where the outputs OP2 (Sk−1) and OP2 (Sk+1) of the height detecting sensors Sk−1 and Sk+1 do not fall below the adjacent threshold values TH2 (Sk−1) and TH2 (Sk+1), i.e., No in Step S409, the CPU 81 advances the process to Step S210. In Step S210, the CPU 81 judges whether the leading edge of the fed document D has passed through the post-separation sensor S22 and repeats the process of Steps S407 through S409 if the leading edge of the document D has not passed through the post-separation sensor S22. The case of the present embodiment is less influenced by an image formed on the document D because the distance between the document surface DS of the document D and the height detecting sensor Sk is detected based on the time from when the light emitting portion Sk1 irradiates the light and until when the light irradiated from the light emitting portion Sk1 of the height detecting sensor Sk arrives at the photo-sensing portion Sk2.

It is noted that the configuration of the height detect means, such as the height detecting sensors or the lever with the rotary volume, is not limited in all of the embodiment above described. The another type of configuration is applicable as the height detect means as long as the configuration can detect height positions which are positions in the height direction of an uppermost sheet stacked on the stacking surface.

It is noted that the embodiments described above have been described by using the electro-photographic printer, the present disclosure is not limited to such case. For instance, the present disclosure is applicable also to an ink-jet type image forming apparatus configured to form an image on a sheet by discharging ink droplets from a nozzle.

Still further, while the bound document has been detected from the variation of the height positions of the document before feeding the document and in feeding the document in all of the embodiments described above, the present disclosure is not limited to such configuration. For instance, it is also possible to arrange such that the feed of the document is stopped corresponding to a height position of the document detected in feeding the document without detecting the height position of the document before feeding the document.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-014632, filed Jan. 30, 2017, which is hereby incorporated by reference wherein in its entirety.

What is claimed is:

1. A sheet feeding apparatus, comprising:

a stacking surface on which a sheet is stacked;

a feed portion configured to feed the sheet stacked on the stacking surface in a sheet feeding direction;

first and second detecting portions disposed at positions different from each other in a width direction orthogonal to the sheet feeding direction and so as to overlap with the stacking surface in a view from a height direction orthogonal to the stacking surface, the first and second detecting portions being configured to detect height positions which are positions in the height direction of an uppermost sheet stacked on the stacking surface at the respective positions in the width direction; and a control portion configured to start feeding the sheet stacked on the stacking surface by the feed portion and to stop feeding the sheet by the feed portion, wherein the control portion is configured to stop feeding the sheet based on at least one of a height position detected by the first detecting portion and a height position detected by the second detecting portion in feeding the sheet.

2. The sheet feeding apparatus according to claim 1, wherein the control portion stops feeding the sheet by the feed portion in a case where a difference between a height position detected by one of the first and second detecting portions before feeding the sheet by the feed portion and a height position detected by the one of the first and second detecting portions in feeding the sheet is larger than a predetermined first value.

3. The sheet feeding apparatus according to claim 2, wherein the control portion stops feeding the sheet by the feed portion in a case where a difference between the height position detected by the first detecting portion before feeding the sheet by the feed portion and the height position detected by the first detecting portion in feeding the sheet by the feed portion, and a difference between the height position detected by the second detecting portion before feeding the sheet by the feed portion and the height position detected by the second detecting portion in feeding the sheet by the feed portion are both larger than a predetermined second value and smaller than the predetermined first value.

4. The sheet feeding apparatus according to claim 1, wherein the higher height positions of the uppermost sheet are, the larger detection values output by the first and second detecting portions are, and the control portion sets a first threshold value for the first detecting portion based on a detection result of the first detecting portion and a second threshold value for the second detecting portion based on a detection result of the second detecting portion before feeding the sheet by the feed portion, and stops feeding the sheet by the feed portion in a case where the first detecting portion detects a detection value larger than the first threshold value or the second detecting portion detects a detection value larger than the second threshold value in feeding the sheet.

5. The sheet feeding apparatus according to claim 4, wherein the control portion sets a third threshold value smaller than the first threshold value for the first detecting portion based on a detection result of the first detecting portion and sets a fourth threshold value smaller than the second threshold value for the second detecting portion based on a detection result of the second detecting portion before feeding the sheet by the feed portion, and stops feeding the sheet by the feed portion in a case where the first detecting portion detects a detection value larger than the third threshold value and the second detecting portion detects a detection value larger than the fourth threshold value.

6. The sheet feeding apparatus according to claim 1, wherein the higher height positions of the uppermost sheet are, the smaller detection values output by the first and second detecting portions are, and the control portion sets a first threshold value for the first detecting portion based on a detection result of the first detecting portion and a second threshold value for the second detecting portion based on a detection result of the second detecting portion before feeding the sheet by the feed portion, and stops feeding the sheet by the feed portion in a case where the first detecting portion detects a detection value smaller than the first threshold value or the second detecting portion detects a detection value smaller than the second threshold value in feeding the sheet.

7. The sheet feeding apparatus according to claim 6, wherein the control portion sets a third threshold value smaller than the first threshold value for the first detecting portion based on a detection result of the first detecting portion and sets a fourth threshold value smaller than the second threshold value for the second detecting portion based on a detection result of the second detecting portion before feeding the sheet by the feed portion, and stops feeding the sheet by the feed portion in a case where the first detecting portion detects a detection value smaller than the third threshold value and the second detecting portion detects a detection value smaller than the fourth threshold value.

8. The sheet feeding apparatus according to claim 1, wherein the control portion stops feeding the sheet by the feed portion in a case where a difference between the height position detected by the first detecting portion before feeding the sheet by the feed portion and the height position detected by the first detecting portion in feeding the sheet by the feed portion, and a difference between the height position detected by the second detecting portion before feeding the sheet by the feed portion and the height position detected by the second detecting portion in feeding the sheet by the feed portion are both larger than a predetermined second value.

9. The sheet feeding apparatus according to claim 1, wherein the higher height positions of the uppermost sheet are, the larger detection values output by the first and second detecting portions are, and the control portion sets a third threshold value for the first detecting portion based on a detection result of the first detecting portion and sets a fourth threshold value for the second detecting portion based on a detection result of the second detecting portion before feeding the sheet by the feed portion, and stops feeding the sheet by the feed portion in a case where the first detecting portion detects a detection value larger than the third threshold value and the second detecting portion detects a detection value larger than the fourth threshold value in feeding the sheet.

10. The sheet feeding apparatus according to claim 1, wherein the higher height positions of the uppermost sheet are, the smaller detection values output by the first and second detecting portions are, and the control portion sets a third threshold value for the first detecting portion based on a detection result of the first detecting portion and sets a fourth threshold value for the second detecting portion based on a detection result of the second detecting portion before feeding the sheet by the feed portion, and stops feeding the sheet by the feed portion in a case where the first detecting portion detects a detection value smaller than the third threshold value and the second detecting portion detects a detection value smaller than the fourth threshold value in feeding the sheet.

11. The sheet feeding apparatus according to claim 1, wherein the first detecting portion is disposed on a first side with respect to the feed portion in the width direction, and the second detecting portion is disposed on a second side, opposite to the first side, with respect to the feed portion in the width direction.

12. The sheet feeding apparatus according to claim 1, wherein the first and second detecting portions detect height positions of an upstream part in the sheet feeding direction of the uppermost sheet stacked on the stacking surface.

13. The sheet feeding apparatus according to claim 1, wherein each of the first and second detecting portion comprises a light emitting portion configured to irradiate the uppermost sheet stacked on the stacking surface with light and a photo-sensing portion configured to receive the light irradiated from the light emitting portion and reflected by the uppermost sheet, and transmits a signal based on a degree of a quantity of light received by the photo-sensing portion to the control portion.

14. The sheet feeding apparatus according to claim 13, wherein the light emitting portion irradiates the light in the height direction.

15. The sheet feeding apparatus according to claim 1, wherein each of the first and second detecting portions comprises a light emitting portion configured to irradiate the uppermost sheet stacked on the stacking surface with light and a photo-sensing portion configured to receive the light irradiated from the light emitting portion and reflected by the uppermost sheet, and transmits a signal based on a time from when the light emitting portion irradiates the light and until when the light irradiated from the light emitting portion is received by the photo-sensing portion to the control portion.

16. The sheet feeding apparatus according to claim 15, wherein the light emitting portion irradiates the light in the height direction.

17. The sheet feeding apparatus according to claim 1, wherein each of the first and second detecting portions comprises a turning portion configured to turn so as to keep a contacting condition between the uppermost sheet and the turning portion and a turn detecting portion configured to detect an angle of turn of the turning portion, and transmits a signal based on a degree of the angle of turn to the control portion.

18. The sheet feeding apparatus according to claim 1, further comprising a separation portion configured to separate the sheet fed by the feed portion one by one, wherein the stacking surface is configured to stack a sheet bundle including a first sheet being the uppermost sheet of the sheet bundle and a second sheet bound with the first sheet, and the first and second detecting portions detect the height positions of a deflection formed on the first sheet by applying a feed force to the first sheet by the feed portion.

19. A sheet feeding apparatus, comprising:

a stacking surface on which a sheet is stacked;

a feed portion configured to feed the sheet stacked on the stacking surface in a sheet feeding direction;

a first detecting portion comprising a first light emitting portion configured to irradiate an uppermost sheet stacked on the stacking surface with light and a first photo-sensing portion configured to receive the light irradiated from the first light emitting portion and reflected by the uppermost sheet, disposed so as to overlap with the stacking surface in a view of a height direction orthogonal to the stacking surface, and configured to detect a height position which is a position of the uppermost sheet in the height direction based on a time from when the first light emitting portion irradiates the light and until when the light irradiated from the first light emitting portion is received by the first photo-sensing portion;

a second detecting portion comprising a second light emitting portion configured to irradiate the uppermost sheet stacked on the stacking surface with light and a second photo-sensing portion configured to receive the light irradiated from the second light emitting portion and reflected by the uppermost sheet, disposed at a position different from that of the first detecting portion in a width direction orthogonal to the sheet feeding direction and so as to overlap with the stacking surface in a view of the height direction, and configured to detect a height position of the uppermost sheet at a position different from a detecting position of the first detecting portion in the width direction based on a time from when the second light emitting portion irradiates the light and until when the light irradiated from the second light emitting portion is received by the second photo-sensing portion; and a control portion configured to start feeding the sheet stacked on the stacking surface by the feed portion and to stop feeding the sheet by the feed portion, wherein the control portion is configured to stop feeding the sheet based on at least one of a height position detected by the first detecting portion and a height position detected by the second detecting portion in feeding the sheet.

20. An image forming apparatus, comprising:

a sheet feeding apparatus comprising:

a stacking surface on which a sheet is stacked;

a feed portion configured to feed the sheet stacked on the stacking surface in a sheet feeding direction;

first and second detecting portions disposed at positions different from each other in a width direction orthogonal to the sheet feeding direction and so as to overlap with the stacking surface in a view from a height direction orthogonal to the stacking surface, the first and second detecting portions being configured to detect height positions which are positions in the height direction of an uppermost sheet stacked on the stacking surface at the respective positions in the width direction; and a control portion configured to start feeding the sheet stacked on the stacking surface by the feed portion and to stop feeding the sheet by the feed portion, the control portion being configured to stop feeding the sheet based on at least one of a height position detected by the first detecting portion and a height position detected by the second detecting portion in feeding the sheet;

an image reading portion configured to read an image of the sheet fed by the sheet feeding apparatus; and an image forming unit configured to form the image based on information of the image read by the image reading portion.

21. An image forming apparatus, comprising:

a sheet feeding apparatus comprising:

a stacking surface on which a sheet is stacked;

a feed portion configured to feed the sheet stacked on the stacking surface in a sheet feeding direction;

a first detecting portion comprising a first light emitting portion configured to irradiate an uppermost sheet stacked on the stacking surface with light and a first photo-sensing portion configured to receive the light irradiated from the first light emitting portion and reflected by the uppermost sheet, disposed so as to overlap with the stacking surface in a view of a height direction orthogonal to the stacking surface, and configured to detect a height position which is a position of the uppermost sheet in the height direction based on a time from when the first light emitting portion irradiates the light and until when the light irradiated from the first light emitting portion is received by the first photo-sensing portion;

a second detecting portion comprising a second light emitting portion configured to irradiate the uppermost sheet stacked on the stacking surface with light and a second photo-sensing portion configured to receive the light irradiated from the second light emitting portion and reflected by the uppermost sheet, disposed at a position different from that of the first detecting portion in a width direction orthogonal to the sheet feeding direction and so as to overlap with the stacking surface in view of the height direction, and configured to detect a height position of the uppermost sheet at a position different from a detecting position of the first detecting portion in the width direction based on a time from when the second light emitting portion irradiates the light and until when the light irradiated from the second light emitting portion is received by the second photo-sensing portion; and a control portion configured to start feeding the sheet stacked on the stacking surface by the feed portion and to stop feeding the sheet by the feed portion, the control portion being configured to stop feeding the sheet based on at least one of a height position detected by the first detecting portion and a height position detected by the second detecting portion in feeding the sheet;

an image reading portion configured to read an image of the sheet fed by the sheet feeding apparatus; and an image forming unit configured to form the image based on information of the image read by the image reading portion.

22. A sheet feeding apparatus, comprising:

a feeding tray comprising a stacking surface on which a sheet is stacked;

a feed roller configured to feed the sheet stacked on the stacking surface in a sheet feeding direction;

a first detecting sensor disposed so as to overlap with the stacking surface in a view of a height direction orthogonal to the stacking surface and being disposed at a first position in a width direction on a first side with respect to the feed roller, and comprising a first light emitting portion configured to irradiate a surface of the sheet on the stacking surface with light and a first light receiving portion configured to receive the light irradiated from the first light emitting portion and reflected by the surface of the sheet, the first detecting sensor being configured to detect a first height position which is a position of the sheet on the stacking surface in the height direction at the first position based on a quantity of light received by the first light receiving portion, the width direction being a direction which is orthogonal to the sheet feeding direction and the height direction;

a second detecting sensor disposed so as to overlap with the stacking surface in a view of the height direction and being disposed at a second position in the width direction on a second side with respect to the feed roller, and comprising a second light emitting portion configured to irradiate the surface of the sheet on the stacking surface with light and a second light receiving portion configured to receive the light irradiated from the second light emitting portion and reflected by the surface of the sheet, the second detecting sensor being configured to detect a second height position which is a position of the sheet on the stacking surface in the height direction at the second position based on a quantity of light received by the second light receiving portion; and a controller configured to obtain the first height position detected by the first detecting sensor and the second height position detected by the second detecting sensor while the feed roller feeds the sheet, and configured to stop feeding the sheet based on the first and second height positions.

23. The sheet feeding apparatus according to claim 22, wherein the controller obtains a variation of the first height position before and in feeding the sheet by the feed roller and a variation of the second height position before and in feeding the sheet by the feed roller.

24. The sheet feeding apparatus according to claim 23, wherein the controller judges whether the sheet is a bound document based on the variation of the first height position before and in feeding the sheet by the feed roller and/or the variation of the second height position before and in feeding the sheet by the feed roller, and stops feeding the sheet by the feed roller if the controller judges the sheet is the bound document.

25. The sheet feeding apparatus according to claim 24, wherein the controller stops feeding the sheet by the feed roller in a case where the first height position detected by the first detecting sensor varies more than a predetermined value and/or where the second height position detected by the second detecting sensor varies more than a predetermined value.

26. The sheet feeding apparatus according to claim 22, wherein the controller stops feeding the sheet by the feed roller in a case where the first height position detected by the first detecting sensor exceeds a first threshold value and/or where the second height position detected by the second detecting sensor exceeds a second threshold value.

27. The sheet feeding apparatus according to claim 26, wherein the controller sets the first and second threshold values before feeding the sheet by the feed roller.

28. The sheet feeding apparatus according to claim 22, further comprising a separating portion configured to separate the sheet fed by the feed roller from another sheet at a separation nip.

29. The sheet feeding apparatus according to claim 22, wherein the first and second detecting sensors are disposed more upstream than the feed roller in the sheet feeding direction.

30. The sheet feeding apparatus according to claim 22, wherein the sheet feeding apparatus is an auto document feeder which feeds the sheet to an image reading unit configured to read an image on the sheet.

* * * * *